US012458830B2

(12) United States Patent
Inzer

(10) Patent No.: US 12,458,830 B2
(45) Date of Patent: Nov. 4, 2025

(54) WEIGHT LIFTING SUPPORT DEVICE INCLUDING A RESTRICTION PANEL

(71) Applicant: INZER ADVANCE DESIGNS, INC., Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 128 days.

(21) Appl. No.: 18/105,035

(22) Filed: Feb. 2, 2023

(65) Prior Publication Data

US 2024/0261620 A1 Aug. 8, 2024

(51) Int. Cl.
*A63B 21/055* (2006.01)
*A63B 21/00* (2006.01)
*A63B 21/04* (2006.01)

(52) U.S. Cl.
CPC .... *A63B 21/0555* (2013.01); *A63B 21/00185* (2013.01); *A63B 21/0414* (2013.01); *A63B 21/0557* (2013.01); *A63B 21/4017* (2015.10)

(58) Field of Classification Search
CPC ..... A63B 21/0555; A63B 21/00185; A63B 21/0414; A63B 21/0557; A63B 21/4017; A63B 21/00; A63B 21/02; A63B 21/05; A63B 21/055; A63B 21/0552; A63B 21/00043; A63B 21/00061; A63B 21/00065; A63B 21/1469; A63B 23/00; A63B 23/12
See application file for complete search history.

(56) References Cited

U.S. PATENT DOCUMENTS 1,432,013 A * 10/1922 Frederick ..... A63B 21/4009 482/124
3,548,818 A * 12/1970 Kaplan ..... A61F 13/146 2/45
4,057,246 A * 11/1977 Wilson ..... A63B 21/0552 482/125
4,090,706 A * 5/1978 Reda ..... A63B 21/0004 482/122
4,540,173 A * 9/1985 Hopkins, Jr. ..... A63B 21/0552 482/139
4,852,874 A * 8/1989 Sleichter, III .... A63B 21/00185 482/122
5,199,940 A * 4/1993 Morris ..... A61F 5/055 602/17
D353,172 S * 12/1994 Gaut ..... D30/152
5,514,059 A * 5/1996 Romney ..... A63B 21/0552 482/121
5,518,481 A * 5/1996 Darkwah ..... A63B 21/4025 482/126

(Continued)

*Primary Examiner* — Garrett K Atkinson
(74) *Attorney, Agent, or Firm* — Dinsmore & Shohl LLP

(57) ABSTRACT

Embodiments described herein are directed to a weight lifting support device. The weight lifting support device includes a panel having a pair of side edges and an elongated member. The elongated member has a first end and an opposite second end. The elongated member is coupled to the panel to define two independent loops. Each of the two independent loops has an opening on positioned either side of the panel and each of the two independent loops and openings thereof extend beyond a respective side edge of the panel. The two independent loops have an elasticity and the panel has a restriction elasticity less than the elasticity of each of the two independent loops.

25 Claims, 15 Drawing Sheets

(56) References Cited

U.S. PATENT DOCUMENTS

| | | | | |
|---|---|---|---|---|
| 5,681,248 | A * | 10/1997 | Vani | A63B 21/0004 482/126 |
| 5,851,167 | A * | 12/1998 | Li | A63B 21/00185 482/125 |
| 5,860,896 | A * | 1/1999 | Mann | A63B 21/4025 482/121 |
| 6,244,998 | B1 * | 6/2001 | Hinds | A63B 21/0552 482/141 |
| 6,659,921 | B2 * | 12/2003 | Vernon | A63B 21/0442 482/114 |
| 7,931,572 | B1 * | 4/2011 | Glauser | A63B 21/0004 482/126 |
| 8,771,155 | B1 * | 7/2014 | Bell | A63B 21/0428 482/125 |
| 9,265,983 | B1 | 2/2016 | Bell | |
| 9,592,418 | B2 * | 3/2017 | Burrell | A63B 21/00043 |
| 9,895,594 | B2 | 2/2018 | Inzer | |
| D819,218 | S | 5/2018 | Inzer | |
| 10,112,072 | B2 * | 10/2018 | Burrell | A63B 21/4025 |
| 10,769,963 | B2 * | 9/2020 | Jewelewicz | A63B 21/045 |
| D905,859 | S | 12/2020 | Inzer | |
| 11,117,014 | B1 * | 9/2021 | Scott | A63B 69/0002 |
| 11,213,713 | B2 * | 1/2022 | Bettini | A63B 21/151 |
| 11,369,831 | B2 * | 6/2022 | Beck | A63B 23/0482 |
| 11,497,953 | B1 * | 11/2022 | Naparstek | A63B 21/0552 |
| 2002/0187884 | A1 * | 12/2002 | McGrath | A63B 21/0552 482/121 |
| 2004/0152569 | A1 * | 8/2004 | Lerner | A63B 21/4015 482/124 |
| 2005/0271857 | A1 * | 12/2005 | Brody | A63B 21/4025 5/420 |
| 2008/0108486 | A1 * | 5/2008 | Vigilia | A63B 21/4025 482/124 |
| 2014/0201883 | A1 | 7/2014 | Achtymichuk | |
| 2015/0082510 | A1 * | 3/2015 | Inzer | A41D 13/0015 2/243.1 |
| 2017/0225060 | A1 * | 8/2017 | Inzer | A63B 23/0405 |
| 2019/0282849 | A1 * | 9/2019 | Val Balent | A63B 71/0054 |
| 2020/0323291 | A1 * | 10/2020 | Inzer | A41D 13/0015 |
| 2020/0352260 | A1 | 11/2020 | Inzer | |
| 2021/0219633 | A1 * | 7/2021 | Forell | A63B 21/0552 |
| 2022/0160056 | A1 * | 5/2022 | Inzer | A63B 21/00181 |

* cited by examiner

WEIGHT LIFTING SUPPORT DEVICE INCLUDING A RESTRICTION PANEL

TECHNICAL FIELD

The present specification generally relates to weight lifting bands supporting specific joints of a wearer, such as while performing a powerlifting exercise and, more specifically, weight lifting bands that restrict the wearer's range of motion during a lifting exercise.

BACKGROUND

Weight lifting bands may be helpful in protecting the shoulders during upward/outward thrust arm movements when lifting weight. Further, lifting bands may assist the wearer by permitting an increase in the amount of weight the user can lift, by removing some of the strain and/or stress from the shoulder area. Conventional weight lifting bands are typically made from knee wrap type material that is wholly elastic. As such, the material of the conventional weight lifting bands continues to stretch or sag at a bottom end of a lifting movement. The sag creates an unstable feel to the wearer and inhibits the upward movement performance of the weight lifting band. Conventional weight lifting bands also tend to slip down the arms of the wearer during a lift, which decreases the support of the weight lifting band.

SUMMARY

In one embodiment, a weight lifting support device is provided. The weight lifting support device includes a panel having a pair of side edges and an elongated member. The elongated member has a first end and an opposite second end. The elongated member is coupled to the panel to define two independent loops. Each of the two independent loops has an opening positioned on either side of the panel and each of the two independent loops and openings thereof extend beyond a respective side edge of the panel. The two independent loops have an elasticity and the panel has a restriction elasticity less than the elasticity of each of the two independent loops.

In another embodiment, a support device is provided. The support device includes a panel, an elongated member, and a plurality of exposed elongate pliable strand members. The panel has a pair of side edges, an exterior surface and an opposite interior surface. The elongated member has a first end and an opposite second end. The elongated member is coupled to the interior surface or the exterior surface of the panel to define two independent loops. Each of the two independent loops has an opening positioned either side of the panel. Each of the two independent loops and openings thereof extend beyond the pair of side edges of the panel. The plurality of exposed elongate pliable strand members positioned on at least one surface of the elongated member. The two independent loops have an elasticity and the panel has a restriction elasticity less than the elasticity of each of the two independent loops.

In yet another embodiment, a support device is provided. The support device includes a panel, an elongated member, and at least a pair of restriction seams. The panel has a pair of side edges, a first terminating edge and an opposite second terminating edge extending between the pair of side edges, an exterior surface and an opposite interior surface. The elongated member has a first end and an opposite second end. The elongated member is coupled to the interior surface or the exterior surface of the panel to define two independent loops. Each of the two independent loops have an opening positioned either side of the panel. The at least pair of restriction seams couple the elongated member and the panel. The at least pair of restriction seams are parallel to one another and extending from the first terminating edge to the second terminating edge of the panel. The two independent loops have an elasticity and the panel has a restriction elasticity less than the elasticity of each of the two independent loops.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
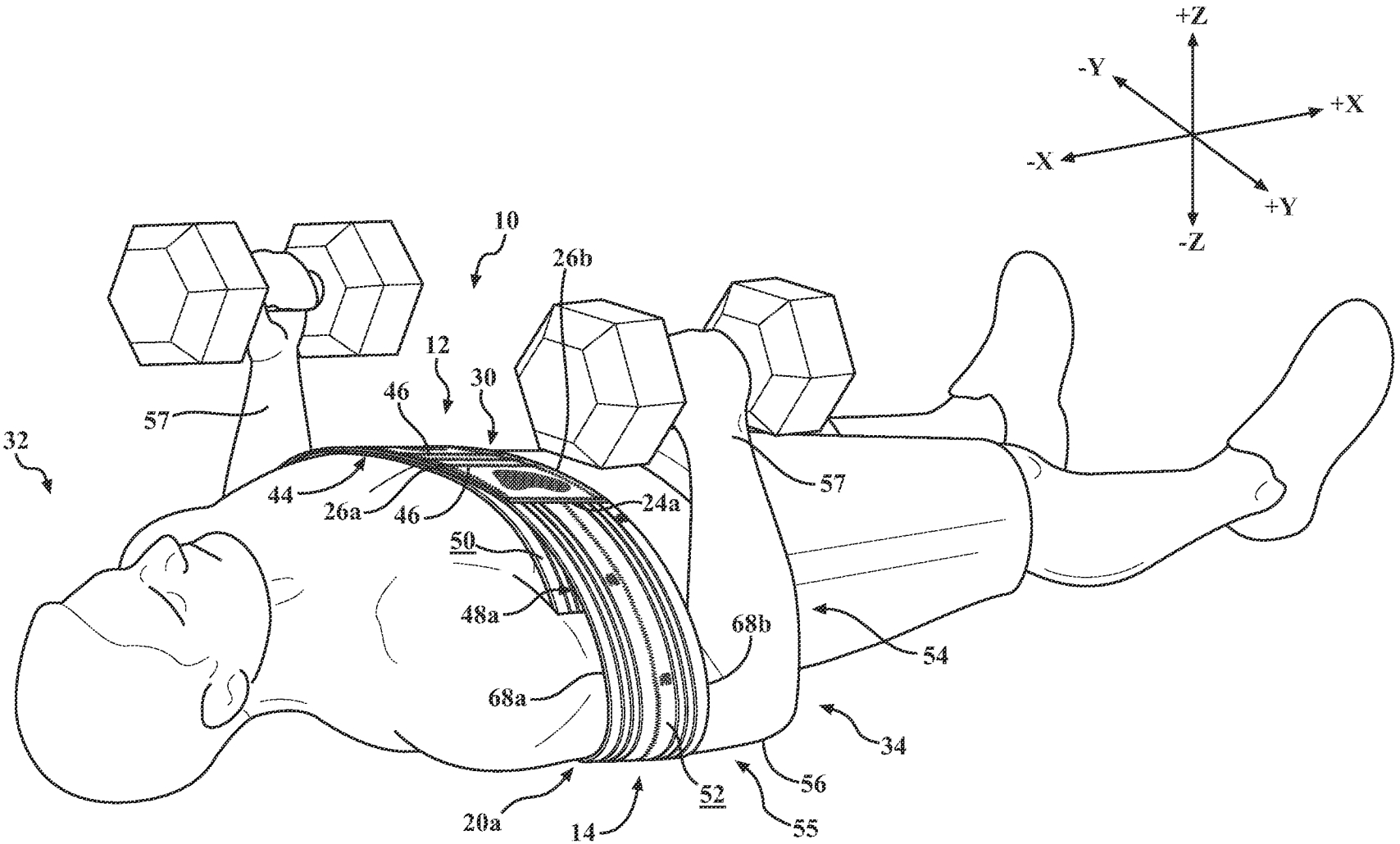
FIG. 1 schematically depicts a perspective view of an example weight lifting support device worn by a wearer, who is holding a pair of dumbbells in a raised position, according to one or more embodiments shown and described herein.

Embodiments described herein are directed to a weight lifting support device that includes an elongated member that permits a wearer to move the wearer's arms in lateral and longitudinal directions and includes a restrictive panel that restrict the arms of the wearer from extending in the longitudinal direction beyond a predetermined distance. Such restriction prevents the wearer from increasing stress on the muscles and joints of the shoulders during upward and/or outward thrust arm movements when lifting weight such as those commonly found in an overhead press, bench press, pushups, decline and incline bench presses, and/or the like.

The weight lifting support device disclosed herein generally includes the restrictive panel having a pair of side edges and the elongated member. The elongated member is coupled by at least a pair of restriction seams to the restrictive panel at a mid-area or mid-portion of the restrictive panel such that the elongated member defines two independent loops. Each of the two independent loops includes an opening, positioned either side of the restrictive panel, and adapted to receive an arm of the wearer. The two independent loops have an elasticity that stretches, and the restrictive panel is formed from a relatively inelastic fabric to have a restriction elasticity less than the elasticity of each of the two independent loops.

The restriction panel and the at least pair of restriction seams of the present disclosure provide advantages over conventional weight lifting support bands. The restriction panel and/or the at least pair of restriction seams of the present disclosure are an improvement over conventional weight lifting support bands in that they prevent or inhibit stretching or sagging of the material of the pair of independent loops at a bottom end of the lifting movement, which causes an undesirable feeling to the wearer. Reducing and/or eliminating the sag and restricting the movement or stretch in the longitudinal direction of the weight lifting support device of the present disclosure improves desirable feeling to the wearer, reduces stresses and strains on the shoulder area of the wearer, and improves an upward movement performance of the wearer when wore on the arms of the wearer. Additionally, by reducing and/or eliminating the sag and restricting the movement or stretch in the longitudinal direction of the weight lifting support device of the present disclosure when wore on the legs of the wearer assists the wearer in squatting more weight, with more stability, and the like.

As used herein, "elasticity" refers to the ability of a material to stretch. A material having a higher, or greater, elasticity than another material stretches a further distance than the other material under the same application of force. A material having a lower, or lesser, elasticity than another material stretches a lesser distance than the other material under the same application of force. Specifically, elasticity may be measured in pounds per square inch (psi) or gigapascals (GPa) using Young's modulus or any other suitable unit for measuring elasticity and strain. For example, when a first material has a greater elasticity than a second material, the first material has a Young's modulus lower or less than the Young's modulus of the second material, e.g., the first material has a lower psi and GPa measurement than the second material. Alternatively, when the first material has a lower elasticity than the second material, the first material has a Young's modulus higher or greater than the Young's modulus of the second material, e.g., the first material has a higher psi and GPa measurement than the second material. As referred to herein, the elasticity and Young's modulus of a material is measured by an overall elasticity of the material, rather than any particular portion or region of the material. As such, the elasticity and Young's modulus of the material is generally the same regardless of a direction in which tension is applied on the material.

As used herein, "relatively inelastic" refers to fabric that does not noticeably stretch and/or minimally stretches when subjected to the stresses and strains associated with its use in a variety of lifting activities. Minimally stretches refers to fabrics that stretch less than twenty-five percent when subjected to the stresses and strains associated with its use in a variety of lifting activities. As such, relatively inelastic materials have a higher Young's modulus than material that is elastic.

As used herein, the term "lateral direction" refers to the forward-rearward direction of the device (i.e., in the +/−Y-direction depicted in FIG. 1). The term "longitudinal direction" refers to the cross-device (i.e., in the +/−X-direction depicted in FIG. 1), and is transverse to the longitudinal direction. The term "vertical direction" refers to the upward-downward direction of the device (i.e., in the +/−Z-direction depicted in FIG. 1).

Referring now to FIGS. 1-10, an embodiment of an example weight lifting support device 10 is schematically depicted. In some embodiments, the example weight lifting support device 10 may include a first panel 12, a second panel 13, and an elongated member 14. The first panel 12 may include a pair of side edges 24*a*, 24*b*, a first terminating edge 26*a*, an opposite second terminating edge 26*b*, an exterior surface 28*a*, and an opposite interior surface 28*b*. The pair of side edges 24*a*, 24*b* may extend in the vertical direction (i.e., in the +/−Z direction) and the first and second terminating edges 26*a*, 26*b* may extend in the longitudinal direction (i.e., in the +/−X direction).

The first panel 12 may be a restrictive panel and include a restrictive panel portion 30 that may extend within the pair of side edges 24*a*, 24*b* and from the first terminating edge 26*a* to the second terminating edge 26*b*. That is, the restrictive panel portion 30 does not extend to each of the pair of side edges 24*a*, 24*b*, but extends between the pair of side edges 24*a*, 24*b* to terminate at the first terminating edge 26*a* and the second terminating edge 26*b*, as best illustrated by the dashed line 31 in FIGS. 3 and 5. In the illustrated embodiment, the restrictive panel portion 30 is a rectangular shape with a length in the vertical direction (i.e., in the +/−Z direction) greater than a width in the longitudinal direction (i.e., in the +/−X direction). As such, in the illustrated embodiment, the restrictive panel portion 30 is illustrated as a strip. This is non-limiting and the restrictive panel portion 30 may be any shape including, without limitation, square, circular, hexagonal, octagonal, and/or the like.

In the illustrated embodiment, the first panel 12 may generally be a rectangular shape. That is, the length of the first and second terminating edges 26*a*, 26*b* in the longitudinal direction (i.e., in the +/−X direction) may extend a greater distance than a height of the pair of side edges 24*a*, 24*b* in the vertical direction (i.e., in the +/−Z direction). This is non-limiting and the first panel 12 may be any shape, including, without limitation, a square, triangular, circular, rhombus, dart, kite, and the like. It should be understood that the shape of the first panel 12 may provide a wearer 32 with varying angles of support, as discussed in greater detail herein. For example, with reference to FIG. 2, an isosceles trapezoid shape of the first panel 12 may allow a greater range of motion for each arm 34 of the wearer 32 as each of the arms 34 bend, as discussed in greater detail herein.

Figure 4:
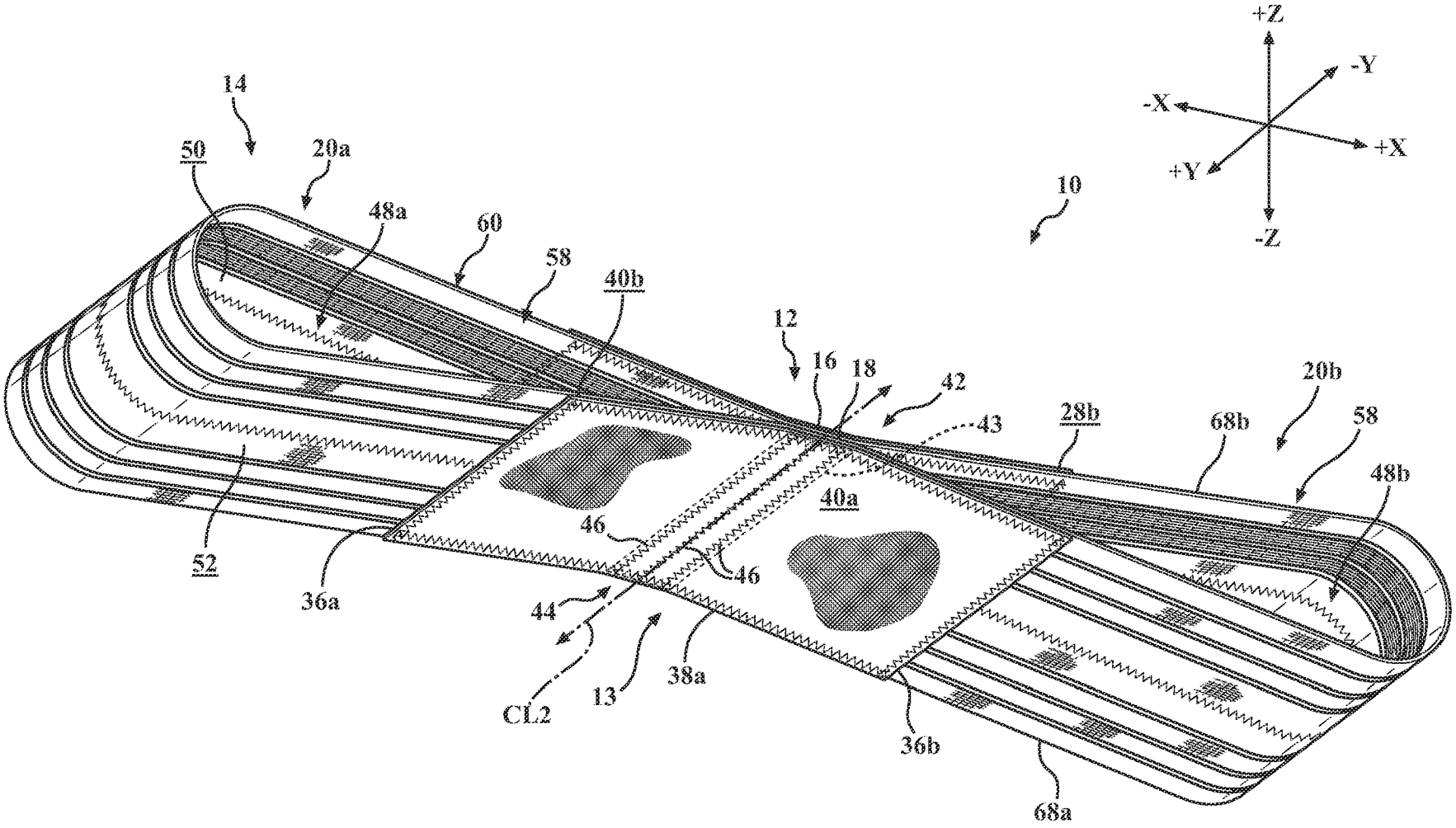
FIG. 4 schematically depicts an isolated perspective view of a rear and bottom of the example weight lifting support device of FIG. 1 according to one or more embodiments shown and described herein.
Figure 5:
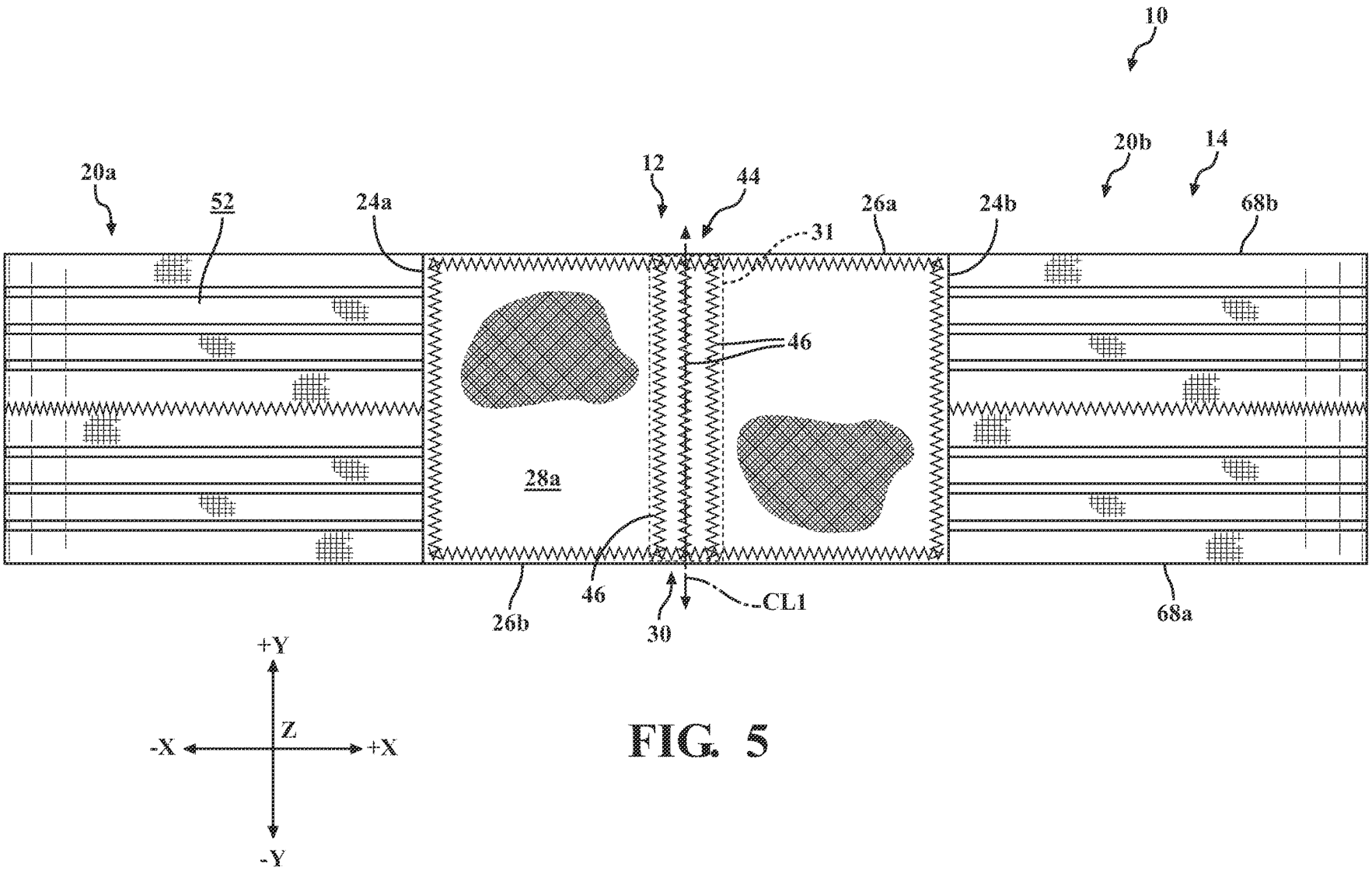
FIG. 5 schematically depicts an isolated top view of the example weight lifting support device of FIG. 1 according to one or more embodiments shown and described herein.
Figure 6:
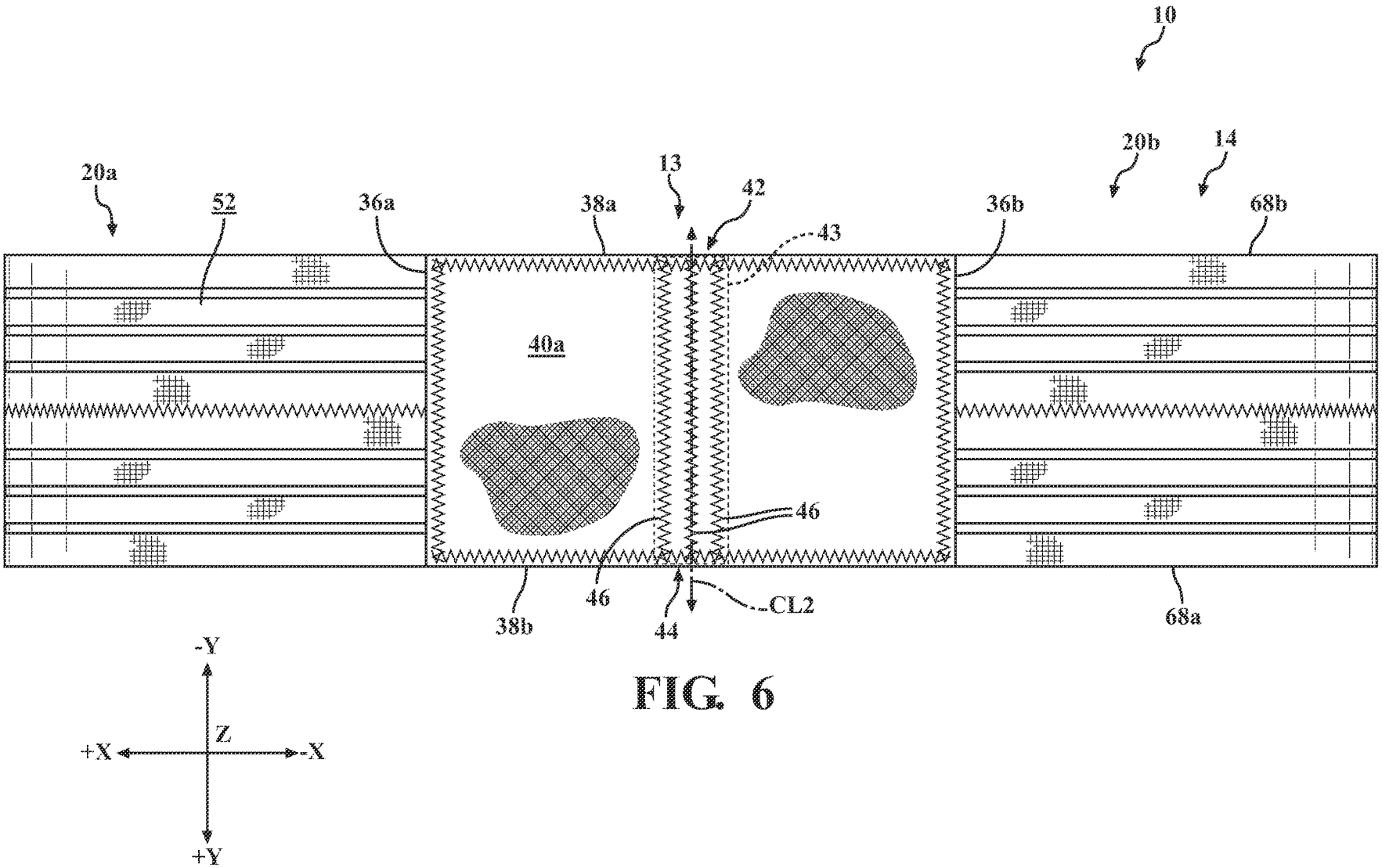
FIG. 6 schematically depicts an isolated bottom view of the example weight lifting support device of FIG. 1 according to one or more embodiments shown and described herein.
Figure 7:
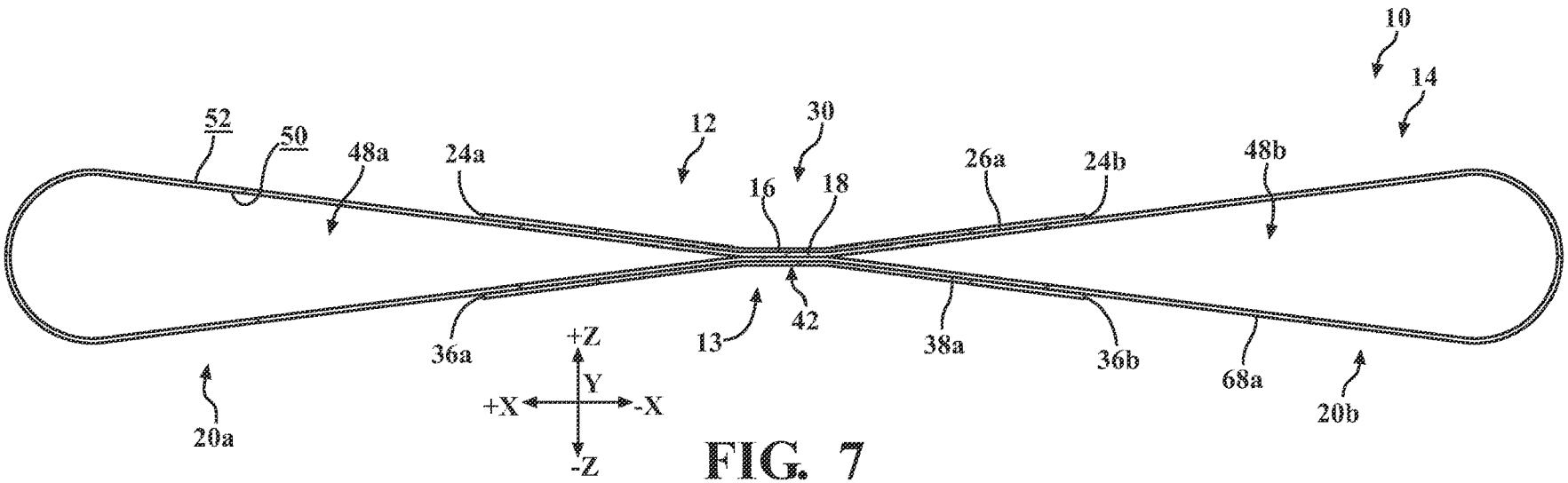
FIG. 7 schematically depicts an isolated front view of the example weight lifting support device of FIG. 1 according to one or more embodiments shown and described herein.
Figure 8:
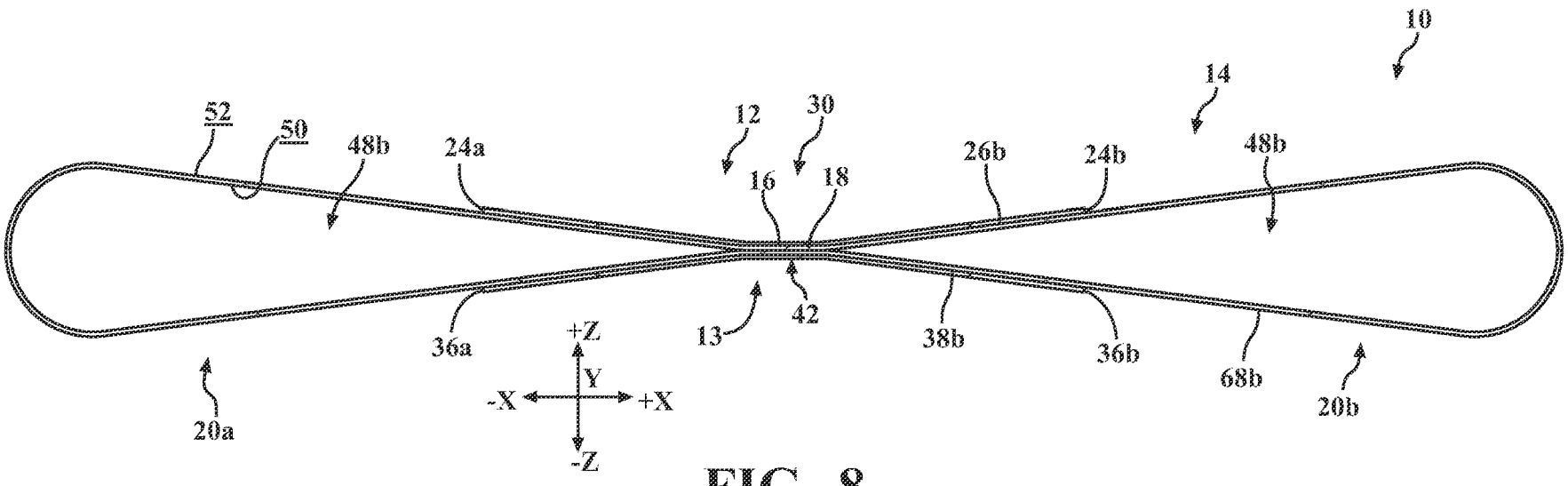
FIG. 8 schematically depicts an isolated rear view of the example weight lifting support device of FIG. 1 according to one or more embodiments shown and described herein.
Figure 9:
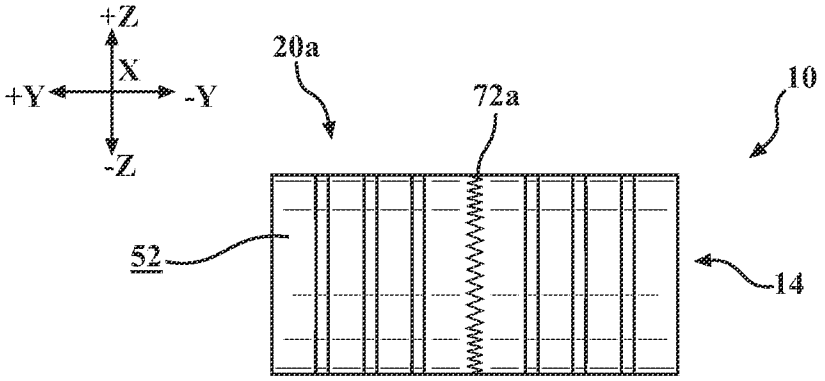
FIG. 9 schematically depicts an isolated end view of the example weight lifting support device of FIG. 1 according to one or more embodiments shown and described herein.
Figure 10:
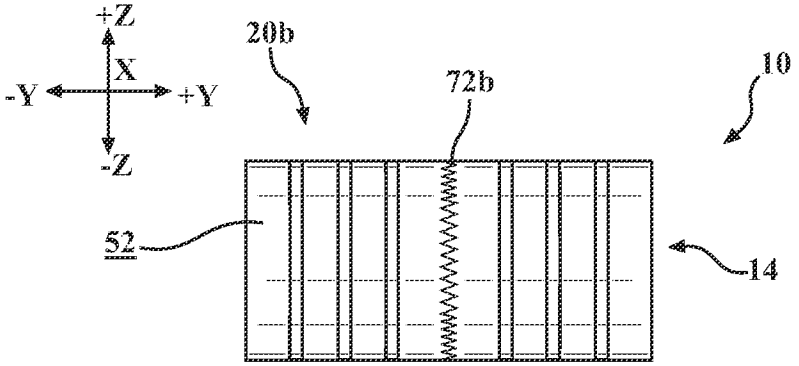
FIG. 10 schematically depicts an isolated view of the other end of the example weight lifting support device of FIG. 1 according to one or more embodiments shown and described herein.

Still referring to FIGS. 1-10, and as best shown in FIG. 4, the second panel 13 may include a pair of side edges 36*a*, 36*b*, a first terminating edge 38*a*, an opposite second terminating edge 38*b*, an exterior surface 40*a*, and an opposite interior surface 40*b*. The pair of side edges 36*a*, 36*b* may extend in the vertical direction (i.e., in the +/−Z direction) and the first and second terminating edges 38*a*, 38*b* may extend in the longitudinal direction (i.e., in the +/−X direction).

The second panel 13 may further include a restrictive panel portion 42 that may extend within the pair of side edges 36*a*, 36*b* and from the first terminating edge 38*a* to the second terminating edge 38*b*. That is, the restrictive panel portion 42 is positioned between or within each of the pair of side edges 36*a*, 36*b* and extends from and/or between the first terminating edge 38*a* and the second terminating edge 38*b* as best illustrated by the dashed line 43 in FIGS. 4 and 6. In the illustrated embodiment, the restrictive panel portion 42 is a rectangular shape with a distance length in the vertical direction (i.e., in the +/−Z direction) greater than a width in the longitudinal direction (i.e., in the +/−X direction). As such, in the illustrated embodiment, the restrictive panel portion 42 is illustrated as a strip. This is non-limiting and the restrictive panel portion 42 may be any shape including, without limitation, square, circular, hexagonal, octagonal, and/or the like.

In the illustrated embodiment, the second panel 13 may generally be a rectangular shape. That is, the distance of the first and second terminating edges 38*a*, 38*b* in the longitudinal direction (i.e., in the +/−X direction) may be larger than a height of the pair of side edges 36*a*, 36*b* in the vertical direction (i.e., in the +/−Z direction). This is non-limiting and the second panel 13 may be any shape, including, without limitation, a square, triangular, circular, rhombus, dart, kite, and the like. Further, in some embodiments, the shape of the second panel 13 may dimensional and geometrically match that of the first panel 12. For example, in some embodiments, when the first panel 12 is the isosceles trapezoid shape as discussed above, the second panel 13 may also be an isosceles trapezoid shape. In another example, in the illustrated embodiment, the first panel 12 and the second panel 13 are each rectangular in shape and positioned to align with one another along the center. For example, a centerline CL1 of the first panel 12 is centered within the restrictive panel portion 30 and a centerline CL2 of the second panel 13 is centered within the restrictive panel portion 42 such that the first panel 12 and the second panel 13 are each aligned or centered with each other.

In other embodiments, the first panel 12 and the second panel 13 may be different shapes. For example, the first panel 12 may be rectangular in shape while the second panel 13 may be square in shape. It should be understood that this is non-limiting and, in other embodiments, the first panel 12 may be any shape and the second panel 13 may be any shape different from the shape of the first panel 12.

In the illustrated embodiment that includes the first panel 12 and the second panel 13, the first and second panels 12, 13 are coupled to and/or attached to one another via a seam 44. In some embodiments, the seam 44 may be at least a pair of restriction seams 46. The at least pair of restriction seams 46 may extend from the first terminating edge 26*a*, 38*a* to the second terminating edge 26*b*, 38*b* within the restrictive panel portion 30, 42 of the first and second panels 12, 13, respectively. Further, the at least pair of restriction seams 46 may be spaced apart from one another and may be parallel to one another extending from the first terminating edge 26*a*, 38*a* to the second terminating edge 26*b*, 38*b*. In other embodiments, the seam 44 may be other fastening types such as adhesive, epoxy, hook and loop, magnetic, and the like.

The first panel 12 and the second panel 13 may each be formed from a relatively inelastic fabric. Further, in some embodiments, the restrictive panel portions 30, 42 may be formed, or reinforced, to provide a more inelastic movement compared to the rest of the first panel 12 and/or the second panel 13, respectively. In some embodiments, the restrictive panel portions 30, 42 may be reinforced to prevent two way or four way movement via additional seams, additional layers, additional thickness, different material types, combinations thereof, and/or the like, to restrict inelastic movement compared to the rest of the first panel 12 and/or the second panel 13, respectively. As such, the restrictive panel portions 30, 42 may each, either independently, or in combination together, provide increases in performance for the wearer by preventing stretching or additional movement in the lateral direction (i.e., in the +/−Y direction), preventing stretching or additional movement in the longitudinal direction (i.e., in the +/−X direction), and/or preventing stretching or additional movement in the vertical direction (i.e., in the +/−Z direction).

In some embodiments, as a non-limiting example, the restrictive panel portions 30, 42 may extend one inch in the longitudinal direction (i.e., in the +/−X direction). This is non-limiting and the restrictive panel portions 30, 42 may extend more than or less than one inch in the longitudinal direction (i.e., in the +/−X direction). Further, in some embodiments, as a non-limiting example, the first panel 12 and/or the second panel 13 may extend, or have a width, between eight inches and sixteen inches in the longitudinal direction (i.e., in the +/−X direction). This is non-limiting and the first panel 12 and/or the second panel 13 may extend more than sixteen inches or less than eight inches in the longitudinal direction (i.e., in the +/−X direction). Additionally, in some embodiments, as a non-limiting example, the first panel 12 and/or the second panel 13 may extend, or have a height, between four inches and eight inches in the vertical direction (i.e., in the +/−Z direction). This is non-limiting and the first panel 12 and/or the second panel 13 may extend more than eight inches or less than four inches in the vertical direction (i.e., in the +/−Z direction).

Examples of relatively inelastic fabrics of the first panel 12 and/or second panel 13 may include, without limitation, broadcloth, muslin cotton, cotton, ploy cotton, crepe, linen, double knit polyester, polyester, satin, sateen, chiffon, viscose, voile, canvas, denim, synthetic fiber, for example, Kevlar®, combinations thereof, and the like. It should be understood that in some embodiments, the first panel 12 and the second panel 13 may each be formed from the same material. In other embodiments, the first panel 12 and the second panel 13 may each be formed from different materials. For example, the first panel may be formed from a cotton while the second panel 13 may be formed from canvass (which may itself be a different cotton depending on its manner of manufacture). It should be appreciated that the first panel 12 and the second panel 13 may each be formed from combinations of multiple materials such as a blend or mixture of cotton and canvass, and/or may include portions of multiple materials.

In some embodiments, the first panel 12 may have a Young's modulus that is greater than the Young's modulus of the second panel 13, and vice-versa. In other embodiments, the first panel 12 and the second panel 13 may have an equal Young's modulus. Further, the first panel 12 alone, the second panel 13 alone, and/or in combination together, have an elasticity that is less than the elasticity of the elongated member 14, as discussed in greater detail herein. Specifically, the first panel 12 alone, the second panel 13 alone, and/or in combination together may have a Young's modulus that is greater than the Young's modulus of the elongated member 14, as discussed in greater detail herein.

It should be understood that in some embodiments, the example weight lifting support device 10 may include either the first panel 12 or the second panel 13, but not both That is, the first panel 12 or the second panel 13 provides the restriction of movement necessary to relieve the strains and/or stresses from the shoulders during an upward and/or outward thrust arm movements when lifting weight such as those commonly found in weight lifting exercises such as overhead press, bench press, pushup, decline and incline bench presses, and the like, as discussed in greater detail herein.

In some embodiments, the elongated member 14 may include a first end 16 and an opposite second end 18 and have a first edge 68*a* and an opposite second edge 68*b* that traverse the length of the elongated member 14. Further, the elongated member 14 includes an inner surface 50 and an opposite outer surface 52. In some embodiments, the first end 16 and the second end 18 may be coupled or otherwise attached to the first panel 12 and/or the second panel 13 to form or define two independent loops 20*a*, 20*b*. For example, in some embodiments, the first end 16 and/or the second end 18 may be coupled or otherwise attached to the interior surface of the first panel 12 and/or to the exterior surface of the second panel 13. In other embodiments, the first end 16 and/or the second end 18 may be coupled or otherwise attached to the exterior surface of the first panel 12. Further, in other embodiments, the first end 16 and/or the second end 18 may be coupled or otherwise attached to the interior surface of the second panel 13. It should be understood that the attachment or coupling of the first end 16 and/or the second end 18 to the first panel 12 and/or the second panel 13 is non-limiting and any part of the elongated member 14 may be attached or coupled to the first panel 12 and/or the second panel 13. That is, portions of the elongated member 14 may be may be attached or coupled to the first panel 12 and/or the second panel 13 to form the two independent loops 20*a*, 20*b* and does not necessarily need to be the first end 16 and/or the second end 18 or may include the first end 16 and/or the second end 18 and other portions of the elongated member 14.

The coupling or attachment of the elongated member 14 to the first panel 12 and/or the second panel 13 may be via the seam 44, such as the at least pair of restriction seams 46, as discussed in greater detail herein. As such, the coupling or attachment of the elongated member 14 to the first panel 12 and/or the second panel 13 may be via the at least pair of restriction seams 46 positioned within the restrictive panel portions 30, 42 of the first and second panels 12, 13, respectively.

In other embodiments, the second end 18 of the elongated member 14 may be coupled to the first end 16 to form a continuous loop. The elongated member 14 may be coupled to the first panel 12 and/or the second panel 13 at a mid-position of the loop of the elongated member 14 to form the two independent loops 20*a*, 20*b*. The coupling or attachment of the elongated member 14 to the first panel 12 and/or the second panel 13 may be via the seam 44 such as the at least pair of restriction seams 46, as discussed in greater detail herein.

The elongated member 14 coupled to the first panel 12 and/or the second panel 13 forms the two independent loops 20*a*, 20*b*, which, in some embodiments, may be of equal size and each may have an opening 48*a*, 48*b* that is equal in size. That is, the elongated member 14 may be coupled to the first panel 12 and/or the second panel 13 such that the two independent loops 20*a*, 20*b* are equally sized with openings 48*a*, 48*b* that are also equally sized. In the continuous loop embodiment, the elongated member 14 may be coupled or attached to the first panel 12 and/or second panel 13 at a mid-position or mid-point such that the two independent loops 20*a*, 20*b* are equally sized.

The two independent loops 20*a*, 20*b* are equally sized with reference or with respect from the coupling or attachment to the first panel 12 and/or the second panel 13. In other embodiments, the elongated member 14 may be coupled to the first panel 12 and/or the second panel 13 in an offset orientation such that one of the two independent loops 20*a*, 20*b* is larger than the other, which causes one of the openings 48*a*, 48*b* to be larger in size compared to the other.

Portions of each of the two independent loops 20*a*, 20*b* and the openings 48*a*, 48*b* may be positioned on either side of the first panel 12 and/or the second panel 13. As such, each of the two independent loops 20*a*, 20*b* include the inner surface 50 and the outer surface 52. The openings 48*a*, 48*b* may be defined by the thickness between the inner surface 50 and outer surface 52 and where the elongated member 14 is coupled to the first panel 12 and/or the second panel 13. Further, each of the two independent loops 20*a*, 20*b* may extend beyond the pair of side edges 24*a*, 24*b*, 36*a*, 36*b* of the first and second panels 12, 13, respectively. The elongated member 14 and each of the two independent loops 20*a*, 20*b* may extend between the first terminating edges 26*a*, 38*a*, and the second terminating edges 26*b*, 38*b* of the first and second panels 12, 13, respectively.

That is, in some embodiments, the first panel 12 and/or the second panel 13 extend in the vertical direction (i.e., in the +/−Z direction) a same height of the elongated member defined by the distance between the first edge 68*a* and the second edge 68*b* of the elongated member 14. That is, the first terminating edges 26*a*, 38*a*, and the second terminating edges 26*b*, 38*b* of the first and second panels 12, 13 terminate at the first edge 68*a* and the second edge 68*b* of the elongated member 14. In other embodiments, the first panel 12 and/or the second panel 13 extend in the vertical direction (i.e., in the +/−Z direction) a height less than or greater than a height between the first edge 68*a* and the second edge 68*b* of the elongated member 14.

Further, portions of the first and second panels 12, 13 may extend in the longitudinal direction (i.e., in the +/−X direction) and/or in the vertical direction (i.e., in the +/−Z direction) to cover, overlie, or overlap portions of the two independent loops 20*a*, 20*b* and portions of the openings 48*a*, 48*b*. That is, in some embodiments, portions of the pair of side edges 24*a*, 24*b*, 36*a*, 36*b*, portions of the first terminating edges 26*a*, 38*a*, and portions of the second terminating edges 26*b*, 38*b* of the first and second panels 12, 13, overlap portions of each of the two independent loops 20*a*, 20*b* and portions of the openings 48*a*, 48*b*.

As such, in some embodiments, the elongated member 14 extends between the first panel 12 and the second panel 13 where the elongated member 14 is fixed between the pair of restriction seams 46. As noted above, the first panel 12 and the second panel 13 are fabricated from a restriction material having a restriction elasticity to have a relatively inelastic stretch or movement. As such, the first panel 12 and/or the second panel 13 restricts the stretching, or elastically, of the elongated member 14 at the coupling or attachment to the first panel 12 and the second panel 13.

Still referring to FIGS. 1-10 and now referring to FIGS. 11-14, the inner surface 50 of the two independent loops 20*a*, 20*b* of the elongated member 14 include a pair of bands 58 extending in the longitudinal direction (i.e., in the +/−X direction) the length of the inner surface 50. It should be understood that this is non-limiting, and in embodiments, there may be a single band or more than a pair of bands 58 positioned on and/or integrated within the inner surface 50 of the elongated member 14.

Figure 11:
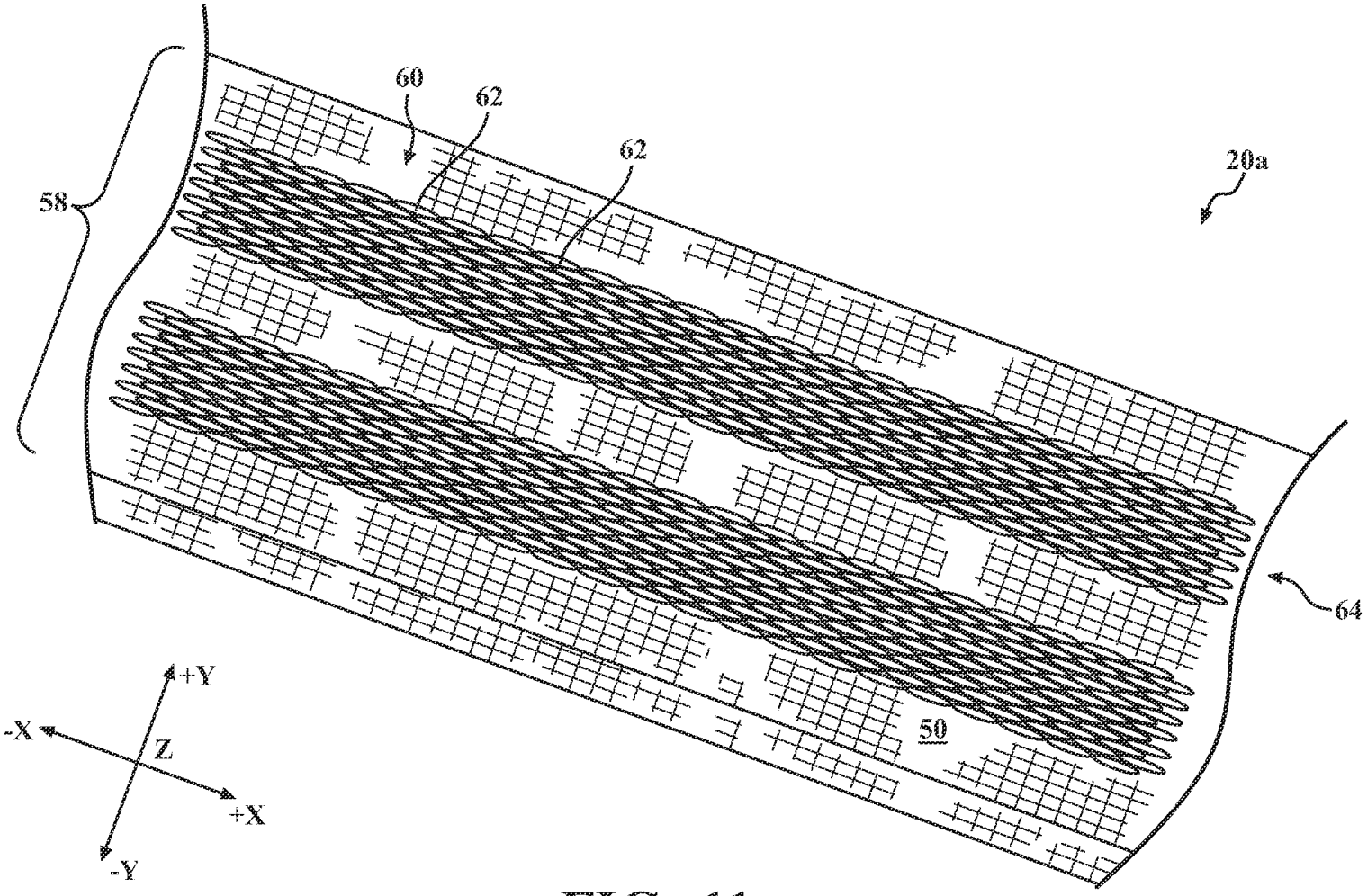
FIG. 11 schematically depicts an isolated perspective view of an inner surface of an elongated member depicting a pair of bands of the example weight lifting support device of FIG. 1 according to one or more embodiments shown and described herein.
Figure 12:
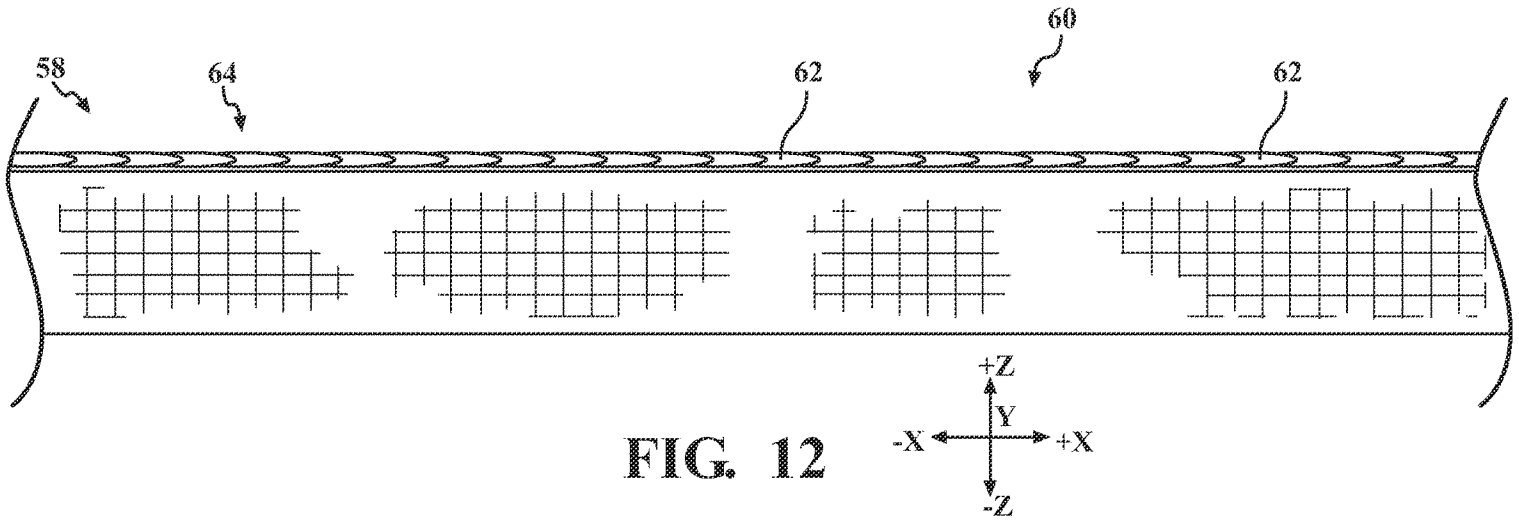
FIG. 12 schematically depicts an isolated side view of the inner surface of the elongated member of FIG. 11 according to one or more embodiments shown and described herein.
Figure 13:
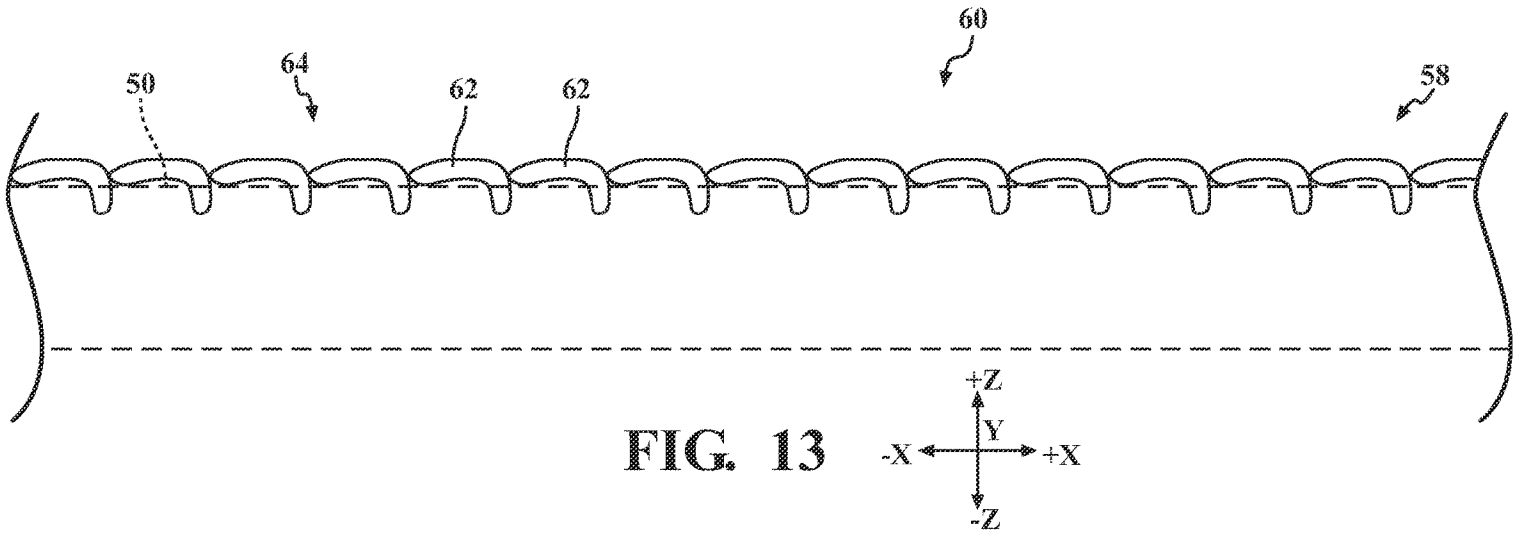
FIG. 13 schematically depicts an isolated side view of the band of FIG. 12 illustrating a plurality of elongate pliable members according to one or more embodiments shown and described herein.
Figure 14:
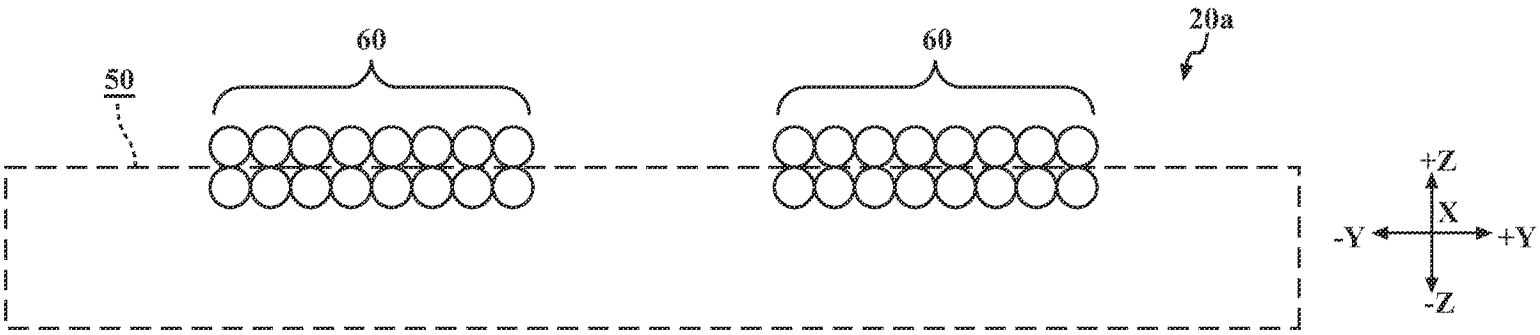
FIG. 14 schematically depicts an isolated front sectional view of the inner surface of the elongated member of FIG. 11 depicting the pair of bands according to one or more embodiments shown and described herein.

For brevity reasons, only the structure of a single band of pair of bands 58 will be discussed. It should be understood that any additional bands include similar structure. In some embodiments, the band 58 may include a plurality of exposed elongate pliable strand members 60 positioned on at least one surface of the two independent loops 20*a*, 20*b*, such as on at least the inner surface 50 of the two independent loops 20*a*, 20*b*. The plurality of exposed elongate pliable strand members 60 may be arranged in an offset lattice configuration such that the arrangement of the plurality of exposed elongate pliable strand members 60 have a coefficient of friction sufficient to provide grip and/or an anti-slip surface for the wearer 32 such that the example weight lifting support device 10 remains positioned as the wearer 32 intended. Each of the plurality of exposed elongate pliable strand members 60 may be elongate pliable members 62 that may be constructed of synthetic rubber. Each of the plurality of the exposed elongate pliable strand members 60 ingress and egress the material of the elongated member 14 such as the inner surface 50 of the two independent loops 20*a*, 20*b*, as best illustrated in FIG. 13, and are in an offset lattice configuration, as best illustrated in FIG. 11. The offset lattice configuration may involve including a small length of synthetic rubber interwoven through the inner surface 50 of the two independent loops 20*a*, 20*b*. Each of individual elongate pliable member of the elongate pliable members 62 ingresses into the inner fabric and extends a distance below the inner surface 50. The individual elongate pliable member of the elongate pliable members 62 of the plurality of exposed elongate pliable strand members 60 egresses around each of the proximate individual elongate pliable member of the elongate pliable members 62, as best illustrated in FIGS. 12-14.

A plurality of small rubber loops 64 are wound in this arrangement, and longitudinally extend (i.e., in the +/−X direction) the length of the elongated member 14. As such, additional rows of rubber loops are added adjacent to the previous row, and the point at which the plurality of the exposed elongate pliable strand members 60 ingress and egress the inner surface 50 of the independent loops 20*a*, 20*b* is offset, in respect to the adjacent row, as best illustrated in FIGS. 12-14. A number of rows of the plurality of the exposed rubber strands adjacent to each other form the bands 58 on the inner surface 50 of the elongated member 14.

In other embodiments, the band 58 may include a rubber coating. For example, silicone gripper tracks or other slip-resistant material that assist in proving grip and/or an anti-slip surface for the wearer 32 such that the example weight lifting support device 10 remains positioned as the wearer 32 intended.

Figure 15:
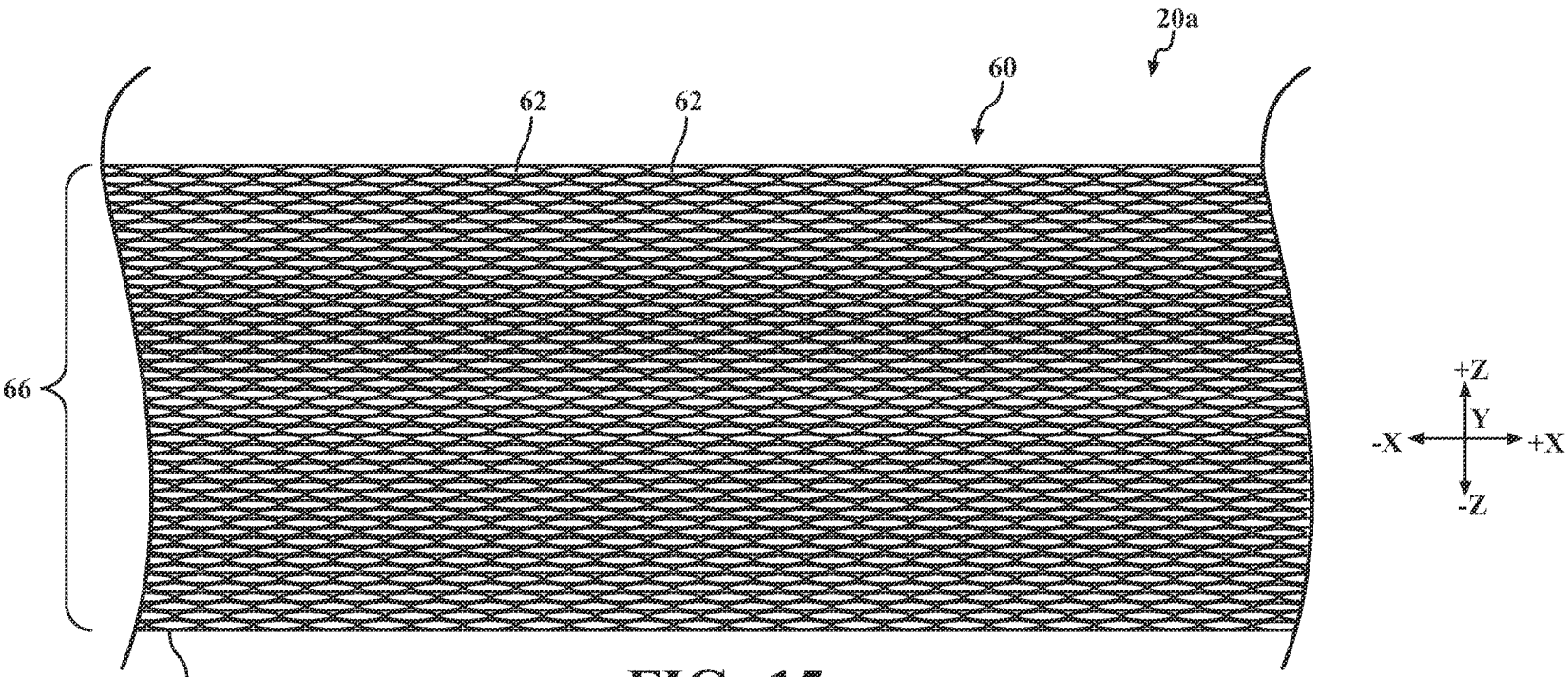
FIG. 15 schematically depicts an isolated top view of a second aspect of the band of FIG. 12 according to one or more embodiments shown and described herein.

Now referring to FIG. 15, in a second aspect, a single band 66 of the plurality of exposed elongate pliable strand members 60 covers the inner surface 50 of the two independent loops 20*a*, 20*b*, and traverses longitudinally (i.e., in the +/−X direction) the distance of the elongated member 14

Figure 16:
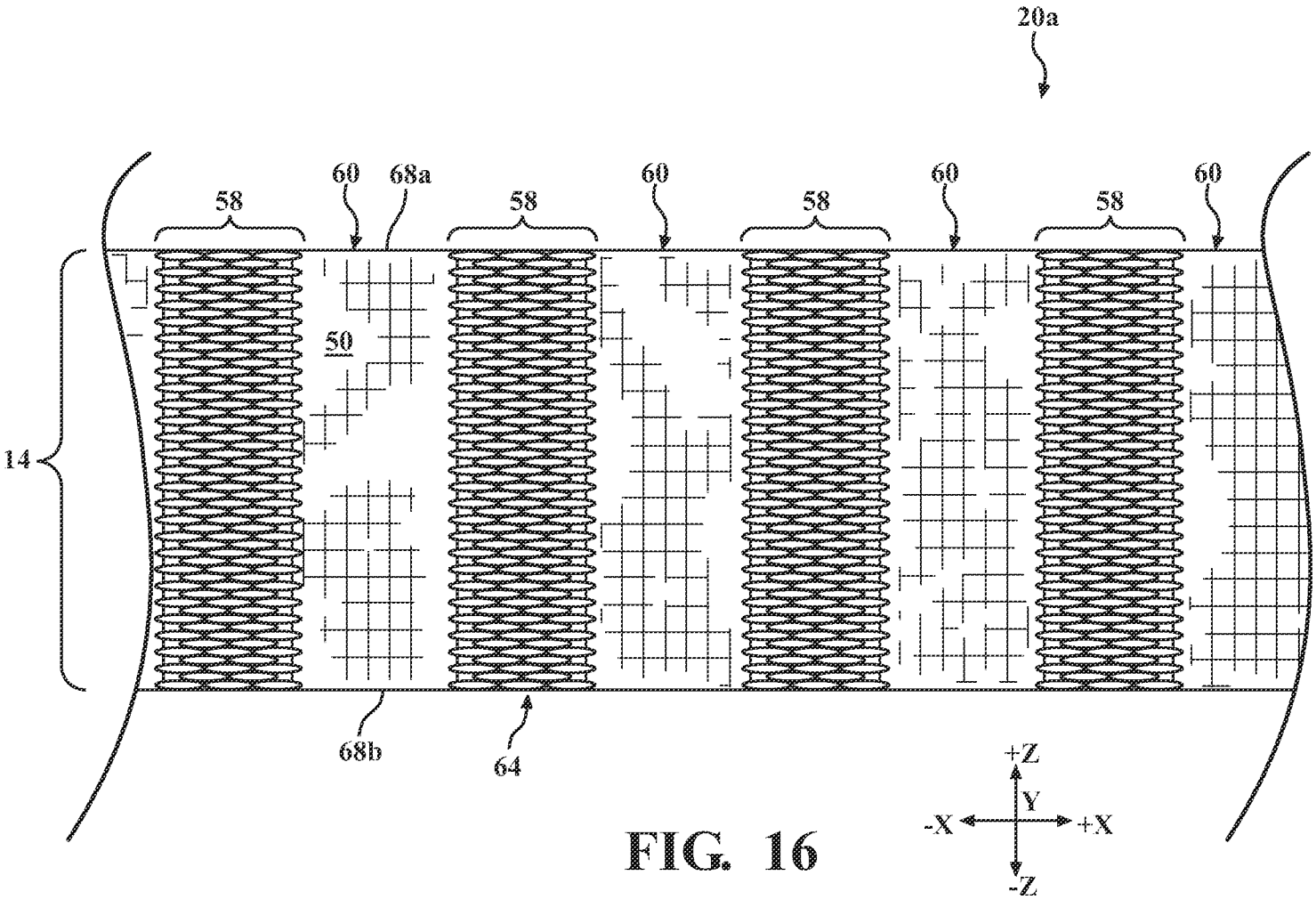
FIG. 16 schematically depicts an isolated top view of a third aspect of the band of FIG. 12 according to one or more embodiments shown and described herein.

Now referring to FIG. 16, in a third aspect, the plurality of bands 58 extend in the lateral direction (i.e., in the +/−Y direction) to be perpendicular across the inner surface 50. The plurality of bands 58 extend the distance of the elongated member between the first edge 68*a* and the second edge 68*b* of the elongated member 14.

Referring back to FIGS. 11-16, it should be appreciated that the configuration, placement, length, width, and placement of bands 58 may differ. For example, the plurality of exposed elongate pliable strand members 60 may be arranged to encompass differing patterns, and shapes, and encompass differing dimensional relationships. In some embodiments, the plurality of exposed elongate pliable strand members 60 may also be constructed of a different material such that the plurality of exposed elongate pliable strand members 60 have a coefficient of friction great enough to grip and/or provide an anti-slip surface to the forearms 54 of the wearer 32.

As such, the bands 58 provide an anti-slip surface for the wearer 32. That is, the bands 58 provide a non-slip texture for the wearer 32. This holding or gripping action prevents the arms 34 of the wearer 32 from sliding and slipping off the wearer 32. As such, the wearer 32 no longer needs to spray sticky or apply chalk to the inner surface 50 and no longer has to breathe toxic fumes from sticky spray or dust from chalk. Further, the arms 34 and clothing of the wearer 32 is kept clean of chalk and sticky spray.

Further, the exposed elongate pliable strand members 60 provide a superior rebound effect (as opposed to conventional weight lifting support bands without exposed rubber strands). The rubber is compressed during the lifting and extending exercises. The compressed rubber reacts against the arms 34 and/or forearms 54 of the wearer 32, depending on how the example weight lifting support device 10 is worn, and rebounds with more kinetic energy return than conventional weight lifting support bands without exposed rubber strands.

Further, the configuration of the exposed elongate pliable strand members 60 as discussed herein does not increase the modulus and squeezing sensation of the elongated member 14 when tightly wound the arm 34 of the user that may be found in conventional wraps or other materials with exposed rubber strands. That is, the looped or braided construction and/or arrangement of the exposed elongate pliable strand members 60 remains relatively loose against the arms 34 of the wearer 32 at a maximum pulled length, which results in less squeezing on body tissues and provides more rubber-bulk than compared to conventional weight lifting support bands and/or wraps which utilize stretched-out rubber or wadded cloth yarn.

Now referring back to FIGS. 1-10, the elongated member 14 is formed from stretchable material. That is, in some embodiments, the elongated member 14 may be a four-way stretch. In other embodiments, the elongated member 14 may be a two-way stretch. In some embodiments, the elongated member 14 may be a woven or non-woven fabric material.

Example materials or fabrics that the elongated member 14 may be formed from include, without limitation, polyester, elastic, cotton fiber, cotton-spandex, nylon, medical crepe, stretch velvet, knit, rubber, latex, neoprene rubber, lycra, elastane, spandex, mesh, power mesh, chiffon, cotton jacquard, cotton sateen, stretch denim, stretch lace, stretch satin, stretch silk, stretch tulle, stretch wool, combinations thereof, and the like.

In should be appreciated that the first and second panels 12, 13 and the elongated member 14 may contain similar fabrics but have different properties such that the elongated member 14 may be elastic and the first and second panels 12, 13 are relatively inelastic. That is, the material of the elongated member 14 has an elasticity greater than the first and second panels 12, 13. As such, the material of the elongated member 14 may have a Young's modulus that is less than the Young's modulus of the material of the first panel 12, the second panel 13, and/or the combination of the first and second panels 12, 13.

Further, in some embodiments, the first and second panels 12, 13 may each, and/or the combination thereof, may have a thickness greater than the thickness defined by the inner surface 50 and outer surface 52 of the elongated member 14. In other embodiments, the first and second panels 12, 13 may be formed of a material different form the material that forms the elongated member 14, where the material of the elongated member 14 has an elasticity greater than the first and second panels 12, 13. As such, the material of the elongated member 14 may have a Young's modulus that is less than the Young's modulus of the material of the first panel 12, the second panel 13, and/or the combination of the first and second panels 12, 13.

That is, the two independent loops 20*a*, 20*b* have an elasticity and the first panel 12, and the second panel 13 have a restriction elasticity that is less than the elasticity of each of the two independent loops 20*a*, 20*b*. As such the first and second panels 12, 13 and/or the at least pair of restriction seams 46 provide many advantages over conventional weight lifting support bands. The first and second panels 12, 13 and/or the at least pair of restriction seams 46 are at least one example of an improvement over conventional weight lifting support bands by preventing or inhibiting stretching or sagging of the material of the two independent loops 20*a*, 20*b* at the bottom end of the lifting movement, which causes a desirable feel to the wearer and improves upward movement performance not accomplished by conventional weight lifting support bands.

Figure 2:
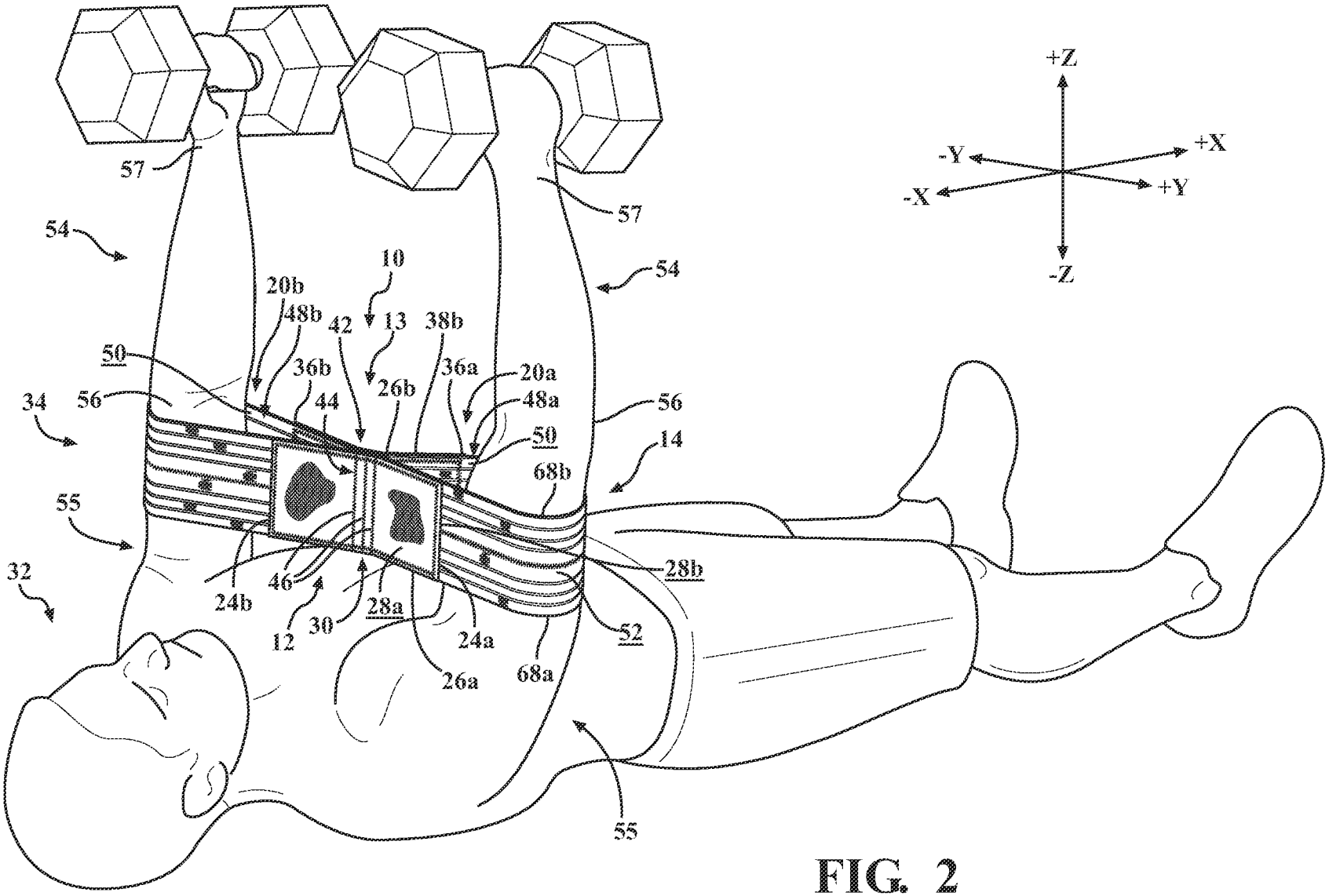
FIG. 2 schematically depicts a perspective view of the example weight lifting support device worn by the wearer, who is holding the pair of dumbbells in an extended position, according to one or more embodiments shown and described herein.
Figure 3:
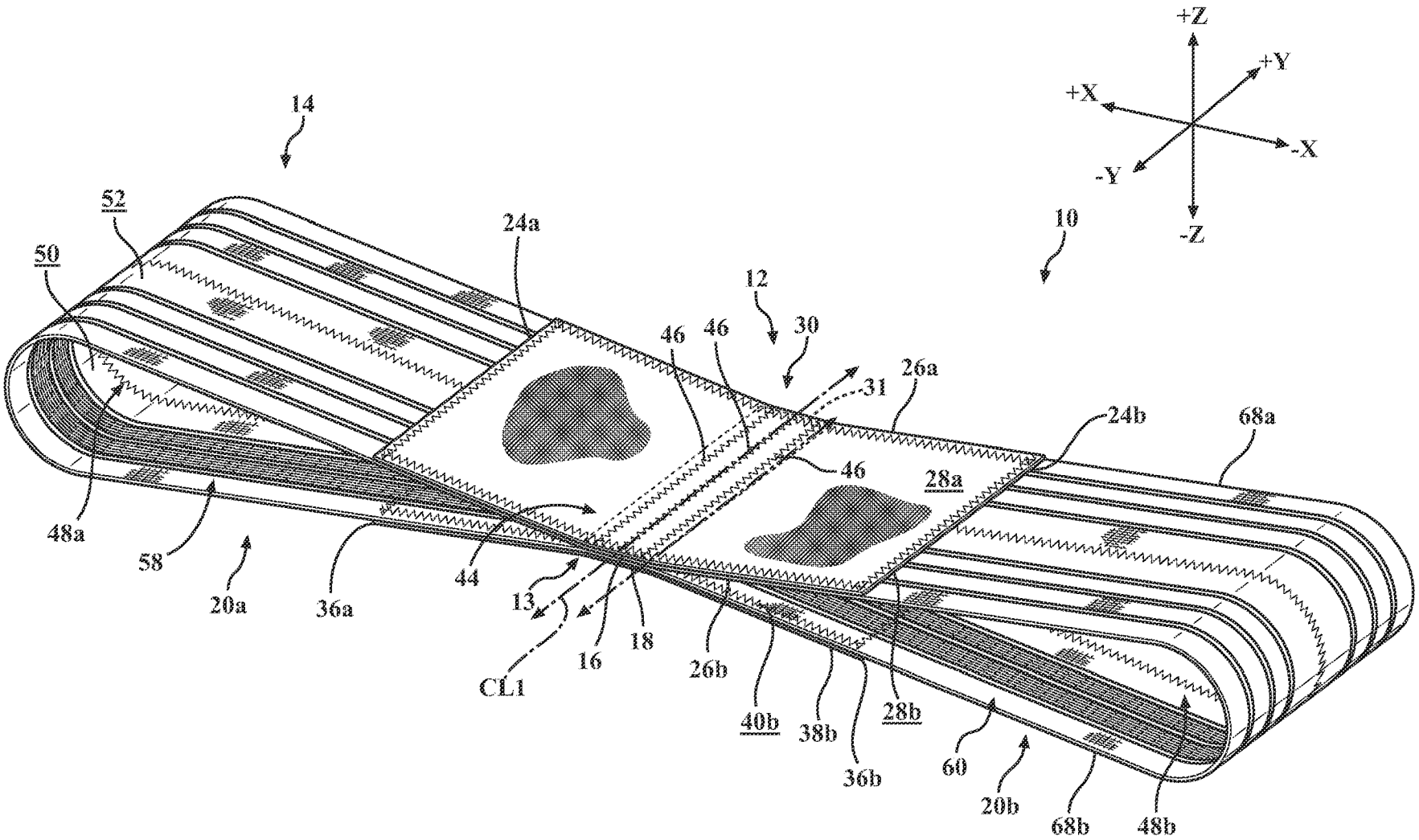
FIG. 3 schematically depicts an isolated perspective view of a front and top of the example weight lifting support device of FIG. 1 according to one or more embodiments shown and described herein.

In operation, in the illustrated example, each of the openings 48*a*, 48*b* of the two independent loops 20*a*, 20*b*, respectively, receive an arm 34 of the wearer 32 and are positioned such that portions of the inner surface 50 is in contact with the arm 34 of the wearer, such as a bicep region 55, as illustrated in FIGS. 1-2. This is non-limiting and the two independent loops 20*a*, 20*b* and inner surface 50 thereof may be positioned onto the forearms 54 between an elbow 56 and a wrist 57 of the wearer 32.

When the arms 34 of the wearer 32 extend from the retracted position, or retracted position, as best illustrated in FIG. 1, toward the extended position, or upward and/or outward position, as best illustrated in FIG. 2, the stretched material of the elongated member 14 is limited in the at least in the longitudinal direction (i.e., in the +/−X direction) to relive stress and strains in the shoulder area. That is, the example weight lifting support device 10 restricts the elasticity of the elongated member 14 at least in the longitudinal direction (i.e., in the +/−X direction) such that when the wearer 32 performs upward and/or outward thrust arm movements when lifting weight, such as those commonly found in exercise such as overhead press, bench press, pushups, decline and incline bench presses, and the like, the shoulders of the wearer 32 are better protected by removing some of the strain and/or stress from the shoulder area in an effort to prevent undesirable conditions to the wearer 32, such as injury. It should be appreciated that the weight lifting support devices disclosed herein are equally applicable in other exercises such as, for example, a powerlifting activity.

Further, the example weight lifting support device 10 increases the amount of weight the wearer 32 may lift based on improved grip of the arms 34 of the wearer 32, improved restriction in the longitudinal direction (i.e., in the +/−X direction) beyond a predetermined position, storing of energy in the press activity, and reducing and/or eliminating a delayed stretch action.

That is, because elastic material stretches first at the point of pull, the further away from the points of pull on a length of elastic, the later the elastic starts stretching. This delayed stretch action causes the center of conventional weight lifting support bands to still be unstretched during an exercise, which decreases the amount of stopping power of conventional weight lifting support bands. It should be understood that stopping power is a commonly used term by weightlifters that indicates a point where, at full stretch, a lifting assist device fully supports, for example, a barbell from sinking further down. As such, stopping power acts as a shelf for the barbell to sit on which increases the wear's ability to raise the barbell upward. As such, the example weight lifting support device 10 also reduces and/or eliminates the delayed stretch action.

It should be understood that the example weight lifting support device 10 is not limited to being applied to the arms of the wearer, and may be worn on each leg of the wearer. For example, each of the openings 48*a*, 48*b* of the two independent loops 20*a*, 20*b*, respectively, receive a leg of the wearer 32 and are positioned such that portions of the inner surface 50 are in contact with the legs of the wearer, such as a thigh region. The example weight lifting support device 10 when wore on the legs of the wearer assists the wearer in squatting more weight, with more stability, and the like.

Figure 17:
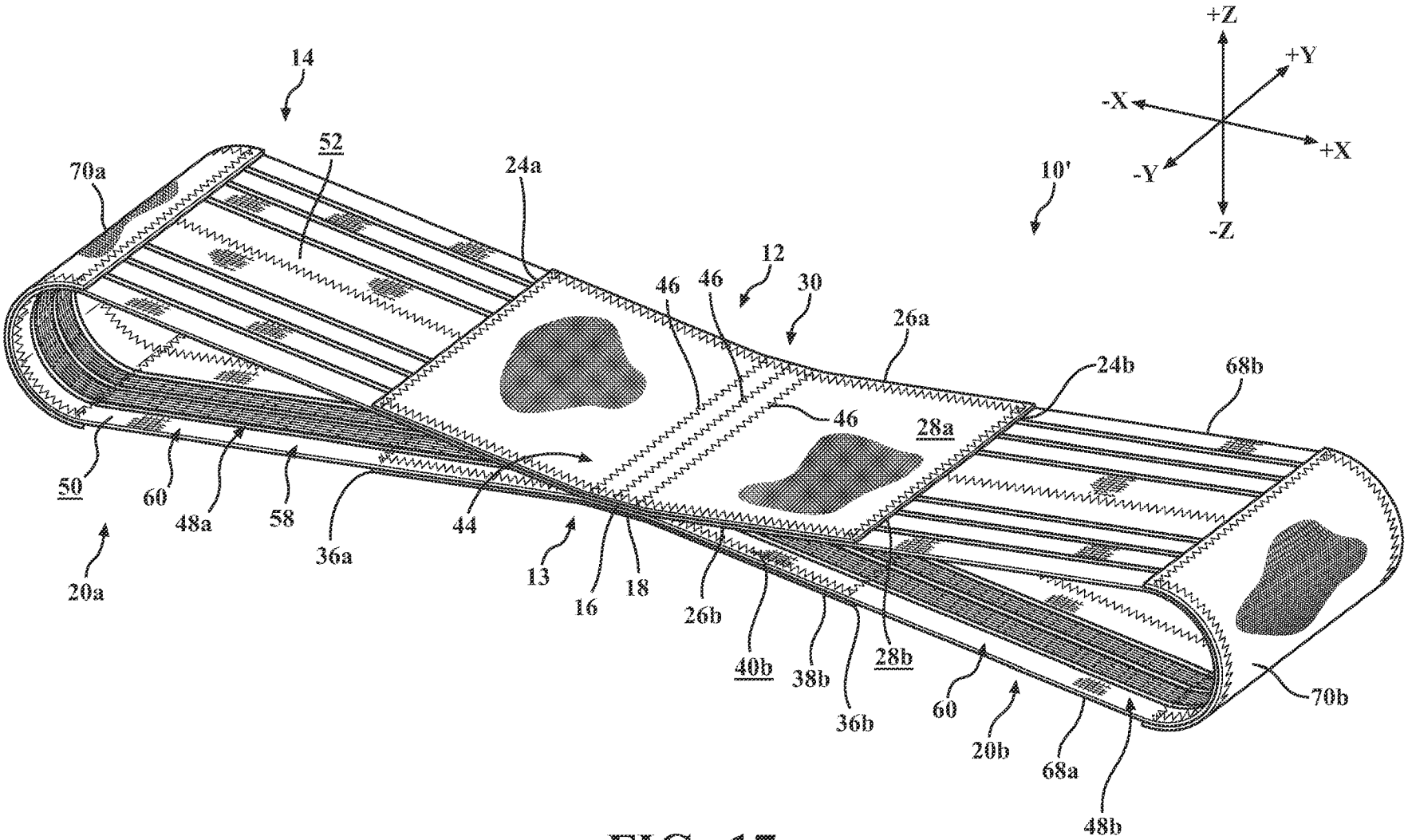
FIG. 17 schematically depicts an isolated perspective view of a second example weight lifting support device of FIG. 1 according to one or more embodiments shown and described herein.
Figure 18:
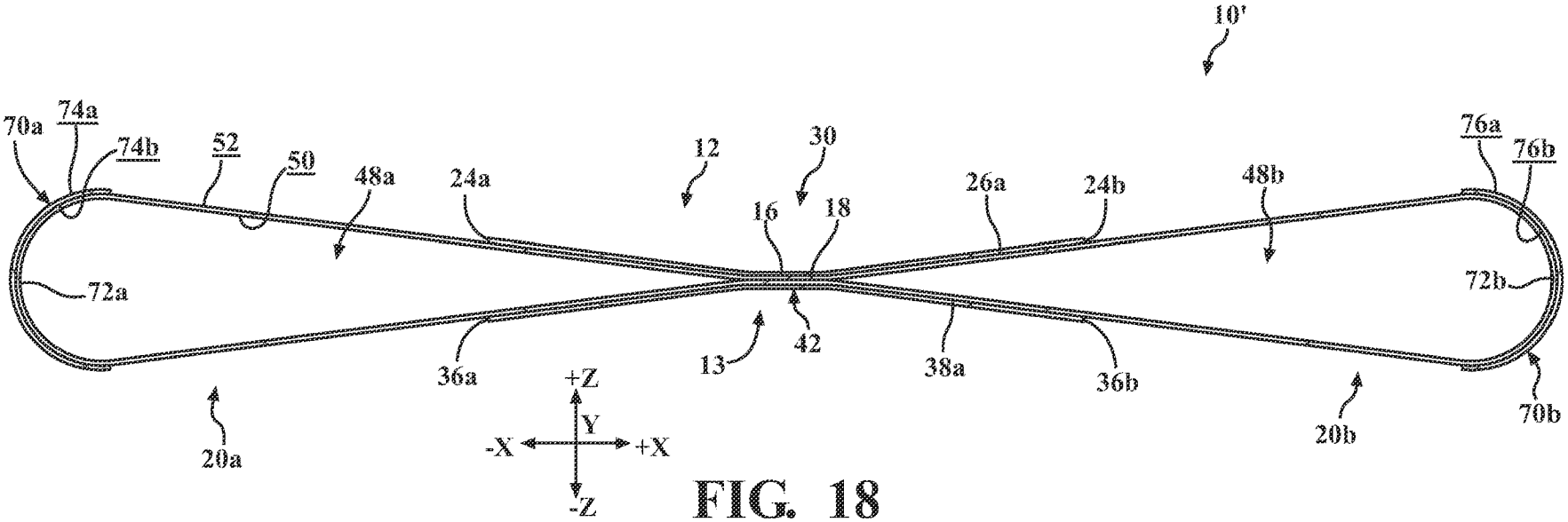
FIG. 18 schematically depicts an isolated front view of the second example weight lifting support device of FIG. 17 according to one or more embodiments shown and described herein.
Figure 19:
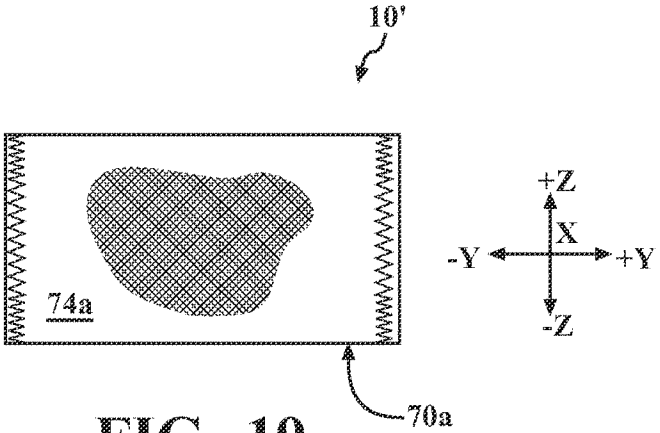
FIG. 19 schematically depicts an isolated end view of the second example weight lifting support device of FIG. 17 according to one or more embodiments shown and described herein.

Referring now to FIGS. 17-19, a second example weight lifting support device 10' is schematically depicted. It should be appreciated that the second example weight lifting support device 10' is similar to the example weight lifting support device 10 discussed above. Therefore, like reference numerals will be used to discuss like parts.

The elongated member 14 of the second example weight lifting support device 10' includes a first restrictive panel 70*a* and a second restrictive panel 70*b* positioned along the outer surface 52 at an apex 72*a*, 72*b* of the two independent loops 20*a*, 20*b*, respectively. Each of the first restrictive panel 70*a* and the second restrictive panel 70*b* include an exterior surface 74*a*, 76*a* and an opposite interior surface 74*b*, 76*b*, respectively. The first restrictive panel 70*a* and the second restrictive panel 70*b* are coupled or otherwise attached to the elongated member 14 such that the interior surface 74*b*, 76*b*, respectively, is coupled or otherwise attached to abut the outer surface 52 of the elongated member 14.

The first restrictive panel 70*a* and the second restrictive panel 70*b* are formed with similar materials as the first and second panels 12, 13 and with similar Young's modulus, as discussed herein. As such, the first restrictive panel 70*a* and the second restrictive panel 70*b* restrict the elasticity of the elongated member 14 at the apex 72*a*, 72*b* of the two independent loops 20*a*, 20*b*. As such, it should be understood that in addition to the center of the conventional weight lifting support bands that has sag or delayed stretch issues, there is an additional point of later stretch point, or sag, at the area where the elastic of the conventional weight lifting support bands rests and/or makes contact with the arms 34 of the wearer 32 causing the elastic of the conventional weight lifting support bands to experience a delay in its stretch. As such, the first restrictive panel 70*a* and the second restrictive panel 70*b* prevent an/or eliminate the delayed stretch in such areas as well as providing all the advantages discussed herein with respect to the first and second panels 12, 13.

Figure 20:
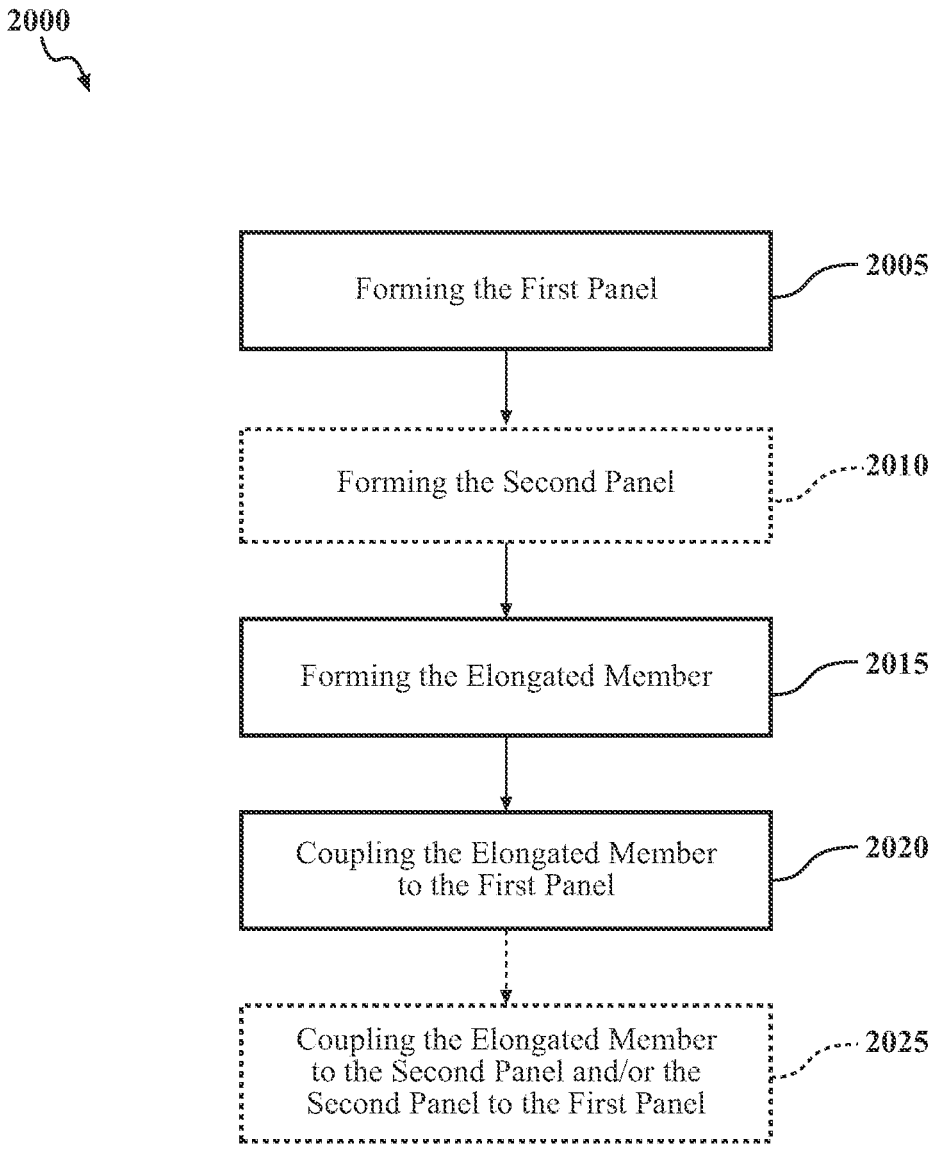
FIG. 20 schematically depicts an illustrative method of manufacturing the example weight lifting support device of FIG. 1 according to one or more embodiments shown and described herein.

Referring now to FIG. 20, which is a flow diagram that graphically depicts an illustrative method 2000 of manufacturing the example weight lifting support device 10. Although the steps associated with the blocks of FIG. 20 will be described as being separate tasks, in other embodiments, the blocks may be combined or omitted. Further, while the steps associated with the blocks of FIG. 20 will described as being performed in a particular order, in other embodiments, the steps may be performed in a different order.

The method of manufacturing the example weight lifting support device 10 includes, at block 2005, the first panel 12 is formed. The first panel 12 is constructed from a relatively inelastic fabric, as discussed in greater detail herein. In some embodiments, at block 2010, the second panel 13 is formed. The second panel 13 is constructed from the relatively inelastic fabric, as discussed in greater detail herein. At block 2015, the elongated member 14 is formed. The elongated member includes the first end 16 and the second end 18. In some embodiments, the first end 16 and second end 18 are coupled to one another to form a continuous loop. In other embodiments, the first end 16 and the second end 18 may remain independent or abut one another without physically attached or coupled to one another.

At block 2020, the elongated member 14 is coupled and/or attached to the first panel 12. The coupling or attaching of the elongated member 14 to the first panel 12 may be at a mid-portion or mid-area of the first panel 12 and the elongated member 14 may be coupled or attached to the first panel 12 to form or define the two independent loops 20*a*, 20*b*. In some embodiments, the elongated member 14 may be coupled to the first panel 12 via the pair of restriction seams 46. In other embodiments, the elongated member 14 may be coupled to the first panel 12 via other fasteners such as adhesive, epoxy, book and loop, magnetic, and the like. The elongated member 14 may be coupled or attached to the exterior surface 28*a* and/or the interior surface 28*b* of the first panel 12.

At block 2025, in some embodiments, the elongated member 14 is additionally coupled and/or attached to the second panel 13. The coupling or attaching of the elongated member 14 to the second panel 13 may be at a mid-portion or mid-area of the second panel 13 and the elongated member 14 may be coupled or attached to the second panel 13 to form or define the two independent loops 20*a*, 20*b*. In some embodiments, the elongated member 14 may be coupled to the second panel 13 via the pair of restriction seams 46. In other embodiments, the elongated member 14 may be coupled to the second panel 13 via other fasteners such as adhesive, epoxy, hook and loop, magnetic, and the like. The elongated member 14 may be coupled or attached to the exterior surface 40*a* and/or the interior surface 40*b* of the second panel 13.

It should be understood that the elongated member 14 may be coupled and/or attached to either the first panel 12, the second panel 13 or both. In embodiments where both the first panel 12 and the second panel 13 are implemented, the pair of restriction seams 46 may couple and/or attach the first panel 12, the second panel 13, and the elongated member 14 to one another such that the thickness of the example weight lifting support device 10 is greater at the coupling point than at the apex 72*a*, 72*b* of the two independent loops 20*a*, 20*b*, respectively. In other embodiments, the first panel 12, the second panel 13, and the elongated member 14 may be coupled to one another via other fasteners such as adhesive, epoxy, hook and loop, magnetic, combinations of these other fasteners and the pair of restriction seams 46, and the like.

From the above, it is to be appreciated that defined herein are weight lifting support devices that include an elongated member and a panel that restrict the arms of the wearer from extending in the longitudinal direction beyond a predetermined distance. Such restriction prevents the wearer from increasing stress on the muscles and joints of the shoulders during upward and/or outward thrust arm movements when lifting weight such as those commonly found in an overhead press, bench press, pushups, decline and incline bench presses, and/or the like.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A weight lifting support device comprising:

a panel having a pair of side edges and a first portion positioned between the pair of side edges;

a second panel positioned to be at least partially overlayed with the panel, the second panel having a second pair of side edges and a second portion positioned between the second pair of side edges; the panel and the second panel being attached together at their respective portions at a seam with the pair of side edges and the second pair of side edges being substantially aligned and spaced apart from one another;

an elongated member having a first end and an opposite second end, the elongated member is coupled to the panel and to the second panel to define two independent loops, each of the two independent loops defining an opening positioned either side of the panel and the second panel, and each of the two independent loops and openings thereof extend beyond a respective side edge of the panel and extend beyond a respective second side edge of the second panel; and wherein each of the two independent loops have an elasticity, the second panel and the panel has a restriction elasticity less than the elasticity of each of the two independent loops.

2. The weight lifting support device of claim 1, wherein the panel or the second panel are formed from a relatively inelastic fabric.

3. The weight lifting support device of claim 2, wherein the relatively inelastic fabric is selected from at least one of a broadcloth, a muslin cotton, a cotton, a ploy cotton, a crepe, a linen, a double knit polyester, a polyester, a satin, a sateen, a chiffon, a viscose, a voile, a canvas, a denim, or a synthetic fiber.

4. The weight lifting support device of claim 1, wherein the panel further comprises:

an exterior surface;

an opposite interior surface;

a first terminating edge; and an opposite second terminating edge, wherein the elongated member extends between the first terminating edge and the second terminating edge of the panel.

5. The weight lifting support device of claim 4, wherein the elongated member is coupled to the interior surface of the panel.

6. The weight lifting support device of claim 4, wherein the pair of side edges, the first terminating edge, and the second terminating edge of the panel extend to cover portions of both of the two independent loops and portions of the openings thereof.

7. The weight lifting support device of claim 4, where the second panel further comprises:

a second exterior surface, an opposite second interior surface, a first edge, and an opposite second edge, wherein the elongated member extends between the first edge and the second edge of the second panel.

8. The weight lifting support device of claim 7, wherein the second panel is dimensionally equal to the panel.

9. The weight lifting support device of claim 7, wherein the elongated member is coupled to either the second exterior surface or the second interior surface of the second panel.

10. The weight lifting support device of claim 7, wherein the second pair of side edges, the first edge, and the second edge of the second panel extend to cover portions of both of the two independent loops and portions of the openings thereof.

11. The weight lifting support device of claim 7, wherein the second panel is coupled to the elongated member and the panel by at least a pair of restriction seams, the at least the pair of restriction seams being parallel to one another and extending from the first terminating edge toward the second terminating edge of the panel and the first edge toward the second edge of the second panel.

12. The weight lifting support device of claim 1, wherein the elongated member is formed from a stretchable material.

13. The weight lifting support device of claim 12, wherein the elongated member is either of polyester, elastic, cotton fiber, medical crepe, or combinations thereof.

14. The weight lifting support device of claim 12, wherein the stretchable material further comprises:

a plurality of exposed elongate pliable strand members on at least one surface of the stretchable material, each of the plurality of elongate pliable stand members ingress and egress the at least one surface of the stretchable material.

15. The weight lifting support device of claim 1, wherein the panel and the second panel are positioned exterior to the respective opening of each of the two independent loops.

16. The weight lifting support device of claim 1, wherein the elasticity of the two independent loops have a Young's modulus that is lower than the Young's modulus of either of the second panel and the panel.

17. The weight lifting support device of claim 1, wherein the panel, the second panel, and the two independent loops are joined at a centerline of the panel and the second panel.

18. The weight lifting support device of claim 1, wherein the panel and the second panel are spaced apart from one another by the elongated member.

19. A support device comprising:

a panel having a pair of side edges, an exterior surface and an opposite interior surface;

a second panel positioned to be at least partially overlayed and attached with the panel at a centerline, the second panel having a second pair of side edges, a second exterior surface and an opposite second interior surface, the pair of side edges and the second pair of side edges being substantially aligned and spaced apart from one another;

an elongated member having a first end and an opposite second end, the elongated member coupled to the interior surface or the exterior surface of the panel and to the second interior surface or the second exterior surface of the second panel to define two independent loops, each of the two independent loops defining an opening positioned either side of the panel and the second panel, each of the two independent loops and the openings thereof extending beyond the pair of side edges of the panel and beyond the second pair of side edges of the second panel; and a plurality of exposed elongate pliable strand members positioned on the exterior surface or the interior surface of the elongated member, wherein each of the two independent loops have an elasticity and the panel and the second panel has a restriction elasticity less than the elasticity of each of the two independent loops.

20. The support device of claim 19, further comprising:

at least a pair of restriction seams couple the elongated member, the panel, and the second panel, wherein:

the panel having a first terminating edge and an opposite second terminating edge extending between the pair of side edges, the second panel having a first edge and an opposite second edge extending between the second pair of side edges, and the at least pair of restriction seams being parallel to one another and extending from the first terminating edge toward the second terminating edge of the panel and extending from the first edge toward the second edge of the second panel such that the panel and the second panel are aligned at a center position with one another.

21. The support device of claim 19, wherein the panel and the second panel are spaced apart from one another by the elongated member.

22. A support device comprising:

a panel having a pair of side edges, a first terminating edge and an opposite second terminating edge extending between the pair of side edges, an exterior surface and an opposite interior surface;

a second panel positioned to be at least partially overlayed and attached with the panel at a centerline, the second panel having a second pair of side edges, a first edge and an opposite second edge extending between the second pair of side edges, a second exterior surface and an opposite second interior surface, the pair of side edges and the second pair of side edges being substantially aligned and spaced apart from one another;

an elongated member having a first end and an opposite second end, the elongated member coupled to the interior surface or the exterior surface of the panel and to the second interior surface or the second exterior surface of the second panel to define two independent loops, each of the two independent loops defining an opening positioned either side of the panel and positioned either side of the second panel; and at least a pair of restriction seams couple the elongated member and the panel, the at least pair of restriction seams being parallel to one another and extending from the first terminating edge to the second terminating edge of the panel, wherein each of the two independent loops have an elasticity and the panel and the second panel each have a restriction elasticity less than the elasticity of each of the two independent loops.

23. The support device of claim 22, further comprising:

a plurality of exposed elongate pliable strand members on at least one surface of the elongated member.

24. The support device of claim 22, wherein:

the at least pair of restriction seams couple the elongated member, the panel, and the second panel such that the at least pair of restriction seams extend from the first edge to the second edge of the second panel.

25. The support device of claim 22, wherein the panel and the second panel are spaced apart from one another by the elongated member.

* * * * *